US010353305B2

(12) United States Patent
Ando

(10) Patent No.: US 10,353,305 B2
(45) Date of Patent: Jul. 16, 2019

(54) ELECTROPHOTOGRAPHIC PHOTORECEPTOR AND IMAGE FORMATION DEVICE

(71) Applicant: MITSUBISHI CHEMICAL CORPORATION, Tokyo (JP)

(72) Inventor: Akira Ando, Kanagawa (JP)

(73) Assignee: MITSUBISHI CHEMICAL CORPORATION, Tokyo (JP)

( * ) Notice: Subject to any disclaimer, the term of this patent is extended or adjusted under 35 U.S.C. 154(b) by 0 days.

(21) Appl. No.: 15/699,440

(22) Filed: Sep. 8, 2017

(65) Prior Publication Data

US 2017/0371254 A1 Dec. 28, 2017

Related U.S. Application Data

(63) Continuation of application No. 14/859,920, filed on Sep. 21, 2015, now Pat. No. 9,874,824, which is a (Continued)

(30) Foreign Application Priority Data

Mar. 22, 2013 (JP) ..... 2013-060368

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/05* (2013.01); *G03G 5/0564* (2013.01); *G03G 5/06* (2013.01);
(Continued)

(58) Field of Classification Search
CPC .. G03G 5/06; G03G 5/07; G03G 5/05; G03G 5/147
See application file for complete search history.

(56) References Cited

U.S. PATENT DOCUMENTS 5,521,044 A 5/1996 Muto et al.
5,851,712 A 12/1998 Muto et al.
(Continued)

FOREIGN PATENT DOCUMENTS

CN 1648782 A 8/2005
CN 102314103 A 1/2012
(Continued)

OTHER PUBLICATIONS

Machine English language translation of JP 11288108 Jun. 14, 1998.*
(Continued)

*Primary Examiner* — Mark A Chapman
(74) *Attorney, Agent, or Firm* — Leason Ellis LLP

(57) ABSTRACT

An electrophotographic photoreceptor comprising at least a photosensitive layer on a conductive substrate, wherein the photosensitive layer is a laminate having a charge transport layer and a charge generation layer, the charge transport layer contains four or more types of compounds each having a maximum absorption wavelength falling within a wavelength range of from 300 nm to 600 nm in a tetrahydrofuran solution at 25° C., and maximum absorption wavelengths falling within the wavelength range of at least four types of the compounds of said four or more types of the compounds are separated from each other by 10 nm or more.

16 Claims, 2 Drawing Sheets

Related U.S. Application Data continuation of application No. PCT/JP2014/057613, filed on Mar. 19, 2014.

(51) Int. Cl.

| | |
|---|---|
| ***G03G 5/147*** | (2006.01) |
| ***G03G 5/06*** | (2006.01) |
| ***G03G 5/05*** | (2006.01) |
| ***G03G 5/07*** | (2006.01) |

(52) U.S. Cl.

CPC ..... *G03G 5/0609* (2013.01); *G03G 5/0614* (2013.01); *G03G 5/0616* (2013.01); *G03G 5/0696* (2013.01); *G03G 5/07* (2013.01); *G03G 5/147* (2013.01); *G03G 5/14708* (2013.01); *G03G 5/14756* (2013.01)

(56) References Cited

U.S. PATENT DOCUMENTS

| | | | | |
|---|---|---|---|---|
| 2004/0185357 | A1* | 9/2004 | Azuma | G03G 5/0609 430/58.05 |
| 2005/0232657 | A1 | 10/2005 | Fuji et al. | |
| 2006/0068310 | A1 | 3/2006 | Nozomi et al. | |
| 2010/0178074 | A1 | 7/2010 | Nakatake et al. | |
| 2012/0003576 | A1 | 1/2012 | Tanaka et al. | |

FOREIGN PATENT DOCUMENTS

| | | | | | |
|---|---|---|---|---|---|
| CN | 102929113 | A | | 2/2013 | |
| JP | 06-27703 | A | | 2/1994 | |
| JP | 07-306536 | A | | 11/1995 | |
| JP | 11288108 | A | * | 6/1998 | G03G 5/043 |
| JP | 11-109666 | A | | 4/1999 | |
| JP | 2000-162791 | A | | 6/2000 | |
| JP | 2004-206109 | A | | 7/2004 | |
| JP | 2006-30975 | A | | 2/2006 | |
| JP | 2006-30976 | A | | 2/2006 | |
| JP | 2007-121751 | A | | 5/2007 | |
| JP | 2008-134573 | A | | 6/2008 | |
| JP | 2010-164639 | A | | 7/2010 | |
| JP | 2011-248251 | A | | 12/2011 | |
| JP | 2012-037660 | A | | 2/2012 | |
| JP | 2012-103333 | A | | 5/2012 | |
| JP | 2013-29789 | A | | 2/2013 | |

OTHER PUBLICATIONS

Office Action dated Oct. 31, 2017 for the corresponding Japanese Patent Application No. 2014-058792.

International Search Report dated May 20, 2014 for the corresponding PCT Application No. PCT/JP2014/057613.

Office Action dated Mar. 1, 2019 for the corresponding Chinese Patent Application No. 201480016810.4 (an English translation attached hereto).

* cited by examiner

ELECTROPHOTOGRAPHIC PHOTORECEPTOR AND IMAGE FORMATION DEVICE

CROSS-REFERENCE TO RELATED APPLICATIONS

The present application is a continuation of U.S. patent application Ser. No. 14/859,920, filed Sep. 21, 2015, which is a continuation of PCT/JP2014/057613, filed Mar. 19, 2014, which claims priority to Japanese Application No. 2013-060368 filed Mar. 22, 2013, the entire contents of which are hereby incorporated by reference as if expressly set forth in their respective entireties herein.

TECHNICAL FIELD

The present invention relates to an electrophotographic photoreceptor for use in copiers, printers and others, and to an image formation device and a cartridge. More precisely, the present invention relates to an electrophotographic photoreceptor in which the charge transport layer contains specific substances and which therefore exhibits performance excellent in lightfastness, and to an image formation device and a cartridge.

BACKGROUND ART

Electrophotography instantaneously provides high-quality images, and is therefore widely used for copiers, printers, printing machines. As the electrophotographic photoreceptor that is the core in electrophotography (hereinafter this may be referred to as "photoreceptor" when appropriate), widely used is one that uses an organic photoconductive substance having the advantages of being free of pollution, easy to form into films and easy to produce.

In planning the photoreceptor, one important characteristic thereof is lightfastness. In general, the photoreceptor is used inside a copier or a printer as shielded from light therein. However, in machine assembling, or in clearing a paper jam in a jammed machine, or for machine maintenance in exchanging a photoreceptor unit at the end of its life for a fresh one, the photoreceptor is inevitably exposed to external light (fluorescent lamp or sunlight).

The intensity of the external light is decidedly higher than the exposure intensity for image formation inside the machine, and as containing many short-wavelength rays, the external light would greatly damage the photoreceptor. This is because, inside the photoreceptor exposed to light, a large amount of charge traps form, therefore causing, in many cases, reduction in charge potential or significant increase in residual potential.

Heretofore for preventing photoreceptors from being damaged by external light, and for example, as the lighting in machine assembling, used is an yellow lamp having less influence on the photoreceptors, or in opening the inside of machines, a douser or the like is employed for protecting the photoreceptor as much as possible from being exposed to light.

On the other hand, for preventing the residual potential of the photoreceptor itself from increasing during exposure to light, for example, various additives that are to be incorporated in a charge transport layer have been investigated (for example, see PTL 1 to 4).

CITATION LIST

Patent Literature

PTL 1: JP-A 2004-206109
PTL 2: JP-A 2006-30975
PTL 3: JP-A 2006-30976
TL 4: JP-A 11-109666

SUMMARY OF INVENTION

Technical Problem

However, in the related art, one type of an additive is incorporated in one charge transport layer in many cases, and there has not been made any trial of incorporating multiple additives in one charge transport layer and intentionally making the additives have a different light-shielding wavelength range. Consequently, the wavelength range capable of exhibiting the light-shielding effect is narrowed and therefore sufficient lightfastness could not be realized, and for attaining the desired lightfastness, the amount of the additive to be incorporated is increased whereby the charge transportability may be retarded and the electric characteristics would be thereby worsened.

The present invention has been made for solving the problems. Specifically, an object of the present invention is to provide an electrophotographic photoreceptor having good shelf life characteristics and good lightfast characteristics, and also to provide a process cartridge and an image formation device.

Solution to Problem

The present inventors have assiduously studied for the purpose of solving the above-mentioned problems and, as a result, have found that incorporating compounds having specific properties into the charge transport layer or the photosensitive layer realizes good lightfastness, and have completed the present invention.

Specifically, the gist of the present invention resides in the following <1> to <12>.

<1> An electrophotographic photoreceptor comprising at least a photosensitive layer on a conductive substrate, wherein:

the photosensitive layer is a laminate having a charge transport layer and a charge generation layer, the charge transport layer contains four or more types of compounds each having a maximum absorption wavelength falling within a wavelength range of from 300 nm to 600 nm in a 0.001 mass % tetrahydrofuran solution at 25° C., and maximum absorption wavelengths falling within the wavelength range of at least four types of the compounds of said four or more types of the compounds are separated from each other by 10 nm or more.

<2> The electrophotographic photoreceptor according to the <1>, wherein the wavelength range is from 300 nm to 500 nm.

<3> The electrophotographic photoreceptor according to the <1> or <2>, wherein the maximum absorption wavelengths falling within said wavelength range of at least four types of the compounds of said four or more types of the compounds are separated from each other by 20 nm or more.

<4> The electrophotographic photoreceptor according to any one of the <1> to <3>, wherein said four or more types of the compounds contain at least a compound of which the maximum absorption wavelength falls within a wavelength range of from 300 to 350 nm and a compound of which the maximum absorption wavelength falls within a wavelength range of from 450 to 500 nm.

<5> The electrophotographic photoreceptor according to any one of the <1> to <4>, wherein the charge transport layer contains a polyarylate resin or a polycarbonate resin.

<6> The electrophotographic photoreceptor according to any one of the <1> to <5>, wherein the charge generation layer contains a phthalocyanine.

<7> The electrophotographic photoreceptor according to any one of the <1> to <6>, wherein three or more types of said four or more types of the compounds are any three or more types of compounds represented by the following formula (I) to formula (VIII):

[Chem. 1]

(I)

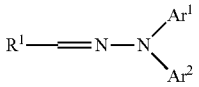

(In the formula (I), $Ar^1$ and $Ar^2$ each independently represent any of an aryl group, an alkoxy group or a hydrogen atom optionally having a substituent; and $R^1$ represents a substituent having from 12 to 30 carbon atoms.)

[Chem. 2]

(II)

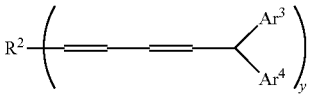

(In the formula (II), $Ar^3$ and $Ar^4$ each independently represent an aryl group, an alkoxy group or a hydrogen atom optionally having a substituent; $R^2$ represents a substituent having from 18 to 70 carbon atoms; and y indicates an integer of from 1 to 3.)

[Chem. 3]

(III)

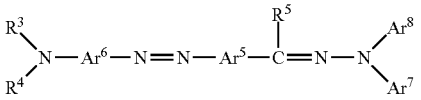

(In the formula (III), $Ar^5$ and $Ar^6$ each represent an arylene group; $Ar^7$ and $Ar^8$ each independently represent an aryl group or an alkoxy group optionally having a substituent; $R^3$ to $R^5$ each independently represent a hydrogen atom, an alkyl group, an alkoxy group, or an aryl group optionally having a substituent.)

[Chem. 4]

(IV)

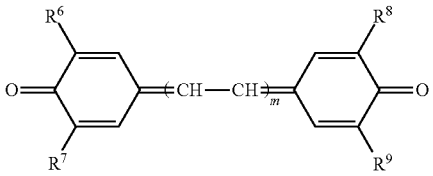

(In the formula (IV), $R^6$ to $R^9$ each independently represents an alkyl group having 6 or less carbon atoms; and m indicates 0 or 1.)

[Chem. 5]

(V)

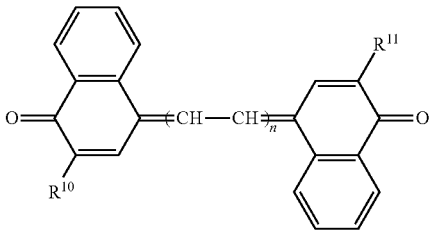

(In the formula (V), $R^{10}$ and $R^{11}$ each independently represent an alkyl group having 6 or less carbon atoms; and n indicates 0 or 1.)

[Chem. 6]

(VI)

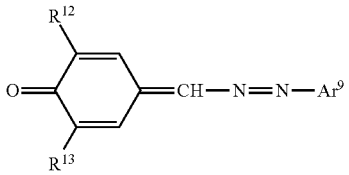

(In the formula (VI), $R^{12}$ and $R^{13}$ each independently represent an alkyl group having 6 or less carbon atoms; and $Ar^9$ represents an aryl group having 30 or less carbon atoms and optionally having a substituent.)

[Chem. 7]

(VII)

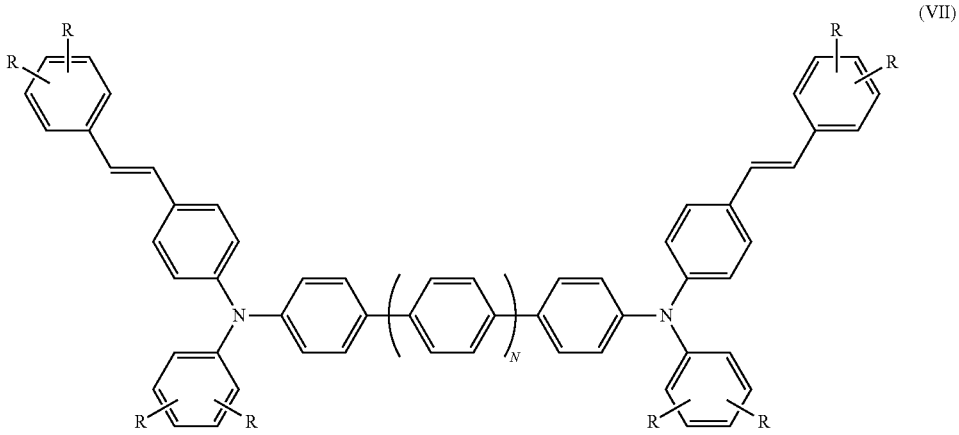

(In the formula (VII), R each independently represents a hydrogen atom, an alkyl group, an alkoxy group, or a phenyl group; and N indicates 0 or 1.)

[Chem. 8]

(VIII)

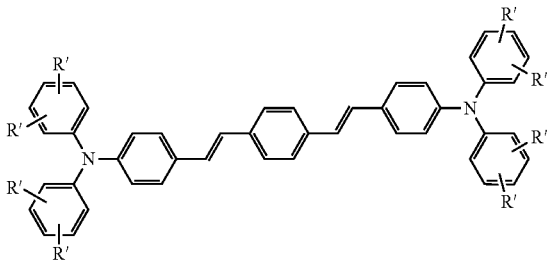

(In the formula (VIII), R' each independently represents a hydrogen atom, an alkyl group, an alkoxy group, or a phenyl group.)

<8> The electrophotographic photoreceptor according to any one of the <1> to <7>, wherein the content of the compound, of which the content is the smallest of said four or more types of the compounds, is from 0.01 to 20 parts by mass relative to 100 parts by mass of the binder resin in the charge transport layer.

<9> The electrophotographic photoreceptor according to the <7> or <8>, wherein the content in the charge transport layer of each of the other compounds than the compound having the largest content of said four or more types of the compounds is from 0.01 to 20 parts by mass relative to 100 parts by mass of the binder resin in the charge transport layer.

<10> The electrophotographic photoreceptor according to any one of the <7> to <9>, wherein the three or more types of said four or more types of the compounds are any three or more types of the compounds represented by the formula (IV), the formula (V) and the formula (VII).

<11> An image formation device comprising the electrophotographic photoreceptor of any one of the <1> to <10>, a charging means of charging the electrophotographic photoreceptor, an exposure means of exposing the charged electrophotographic photoreceptor to light to form an electrostatic latent image, a development means of developing the electrostatic latent image with a toner, a transfer means of transferring the toner to a transferred medium, and a fixation means of fixing the toner transferred to the transferred medium.

<12> An image formation device comprising the electrophotographic photoreceptor of any one of the <1>to <10>, a charging means of charging the electrophotographic photoreceptor, an exposure means of exposing the charged electrophotographic photoreceptor to light to form an electrostatic latent image, a development means of developing the electrostatic latent image with a toner, a transfer means of transferring the toner to a transferred medium, and a fixation means of fixing the toner transferred to the transferred medium, wherein a maximum exposure wavelength of the exposure light for use in the exposure means is from 650 nm to 900 nm.

Advantageous Effects of Invention

According to the present invention, there is provided an electrophotographic photoreceptor excellent in lightfastness. Accordingly, the present invention realizes an electrophotographic process cartridge and an image formation device capable of being handled with ease not requiring any specific means for protection from light.

DESCRIPTION OF EMBODIMENTS

Figure 1:
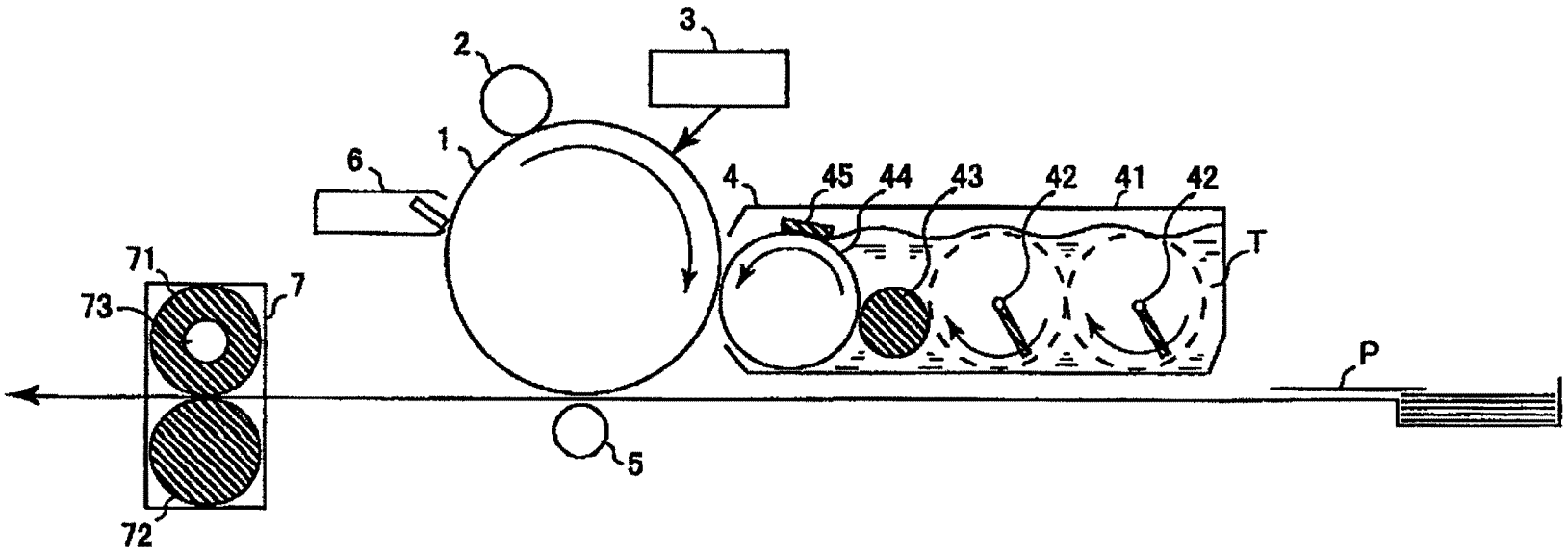
FIG. 1 is a schematic view showing one example of the image formation device of the present invention.

Embodiments for carrying out the present invention are described in detail hereinunder. The present invention is not restricted to the following embodiments, and within the range not overstepping the scope and the spirit thereof, the present invention may be modified and carried out in any desired manner.

Here in the present description, "% by mass" and "% by weight" have the same meaning, and "part by mass" and "part by weigh" have the same meaning.

A typical configuration of the photosensitive layer in the present invention comprises, as laminated on a conductive layer in order, a charge generation layer comprising a charge-generating substance and a binder resin as the main ingredients therein, and a charge transport layer comprising a charge-transporting substance and a binder resin as the main ingredients therein. A protective layer may be further provided outside the layer. Embodiments of the present invention are described in detail hereinunder.

[I. Conductive Substrate]

As the conductive substrate (hereinafter this may be referred to as a conductive support), usable here are any known materials disclosed in JP-A 2007-293319, for example, aluminium, aluminium alloys, etc. In case where a metal material such as an aluminium alloy or the like is used as the conductive support, an anodic oxidation coating film may be formed thereon before use, as disclosed in JP-A 2007-293319.

[II. Undercoat Layer]

An undercoat layer may be provided between the conductive support and the photosensitive layer for improving the adhesiveness and the blocking resistance therebetween. As the undercoat layer, usable here are any known examples disclosed in

[III. Photosensitive Layer]

The laminate-type photosensitive layer includes a sequential laminate-type photosensitive layer that comprises a charge generation layer and a charge transport layer laminated in that order from the side of the conductive support, and an inverse laminate-type photosensitive layer that comprises, contrary to the former, a charge transport layer and a charge generation layer laminated in that order from the side of the conductive support. In the present invention, any of those types may be employed, but preferred is the sequential laminate-type photosensitive layer as capable of exhibiting the most-balanced photoconductivity.

A binder resin is used in the charge generation layer and the charge transport layer for securing the film strength. For the charge transport layer, a charge-transporting substance and a binder resin may be dissolved or dispersed in a solvent, and the resultant coating liquid may be applied to the support and dried thereon to form the layer.

[III-1. Charge Generation Layer]

The charge generation layer contains a charge-generating material and contains generally a binder resin and any other optional component. The charge generation layer may be formed, for example, by dissolving or dispersing fine particles of a charge-generating material and a binder resin in a solvent or a dispersion medium to prepare a coating liquid, and applying it onto a conductive support in a case of a sequential laminate-type photosensitive layer (or in a case of providing an undercoat layer, onto the undercoat layer), or onto the charge transport layer in a case of an inverse laminate-type photosensitive layer, and thereafter drying it.

<Charge-Generating Material>

Regarding examples of the charge-generating material, known materials disclosed in JP-A 2007-293319 may be used here. Of those materials, preferred are phthalocyanine compounds from the viewpoint of the sensitivity thereof; more preferred are metal-containing phthalocyanines that contain a metal in the center of the phthalocyanine ring thereof; and of such metal-containing phthalocyanines, even more preferred are A-type (β-type), B-type (α-type), D-type (Y-type) oxytitanium phthalocyanines, II-type chlorogallium phthalocyanine, V-type hydroxygallium phthalocyanine, G-type μ-oxo-gallium phthalocyanine dimer, etc.; and especially preferred are A-type (β-type), B-type (α-type), and D-type (Y-type) oxytitanium phthalocyanines. Of the oxytitanium phthalocyanines, preferred are those showing main clear diffraction peaks at the Bragg angle (2θ±0.2°) of from 27.0 to 27.2° and from 9.0° to 9.7° in the powdery X-ray diffraction spectrum thereof with CuKα-specific X-ray. Many phthalocyanine compounds have a maximum absorption wavelength within a wavelength range of from 300 to 600 nm, and therefore according to the present invention, it is possible to shield the layer from light falling widely within the above-mentioned range and the effect of lightfastness becomes more remarkable. In case where an azo pigment is used as the charge-generating material, preferably used are various types of known bisazo pigments and trisazo pigments.

Preferably, the mean particle size of the charge-generating material is sufficiently small. Concretely, from the viewpoint of the dispersibility of the material, the particle size is generally 1 μm or less, preferably 0.5 μm or less. Further, when the amount of the charge-generating material to be dispersed in the charge generation layer is too small, the layer could not realize sufficient sensitivity, and therefore, the amount of the charge-generating material to be in the charge generation layer of the laminate-type photosensitive layer is, from the viewpoint of the chargeability and the sensitivity thereof, generally 20% by mass or more in the charge generation layer, preferably 40% by mass or more, and from the viewpoint of the smoothness owing to aggregation, the amount is generally 90% by mass or less, preferably 70% by mass or less.

<Binder Resin>

The binder resin for use in the charge generation layer is not specifically defined. For example, usable are the known materials disclosed in JP-A 2007-293319. Of those materials, preferred are polyvinyl alcohol resins or polyvinyl acetal resins.

[III-2. Charge Transport Layer]

<Four or More Types of Compounds>

The four or more types of the compounds to be used in the present invention each have at least one maximum absorption wavelength within a wavelength range of from 300 nm to 600 nm in a 0.001 mass % tetrahydrofuran solution at 25° C. The maximum absorption wavelength is a wavelength that gives a maximum absorption peak in electronic absorption spectrometry. In a case where a compound has multiple maximum absorption wavelengths, it is enough that only one of those maximum absorption wavelengths of the compound falls within the above-mentioned wavelength range. On the other hand, in a case where one compound has multiple maximum absorption wavelengths all falling within the wavelength range, it is enough that any of those maximum absorption wavelengths could satisfy the relationship to be mentioned below relative to the maximum absorption wavelength of the other compounds. The relationship is that the maximum absorption wavelengths falling within the above-mentioned wavelength range of at least four types of the compounds of the above-mentioned four or more types of the compounds are separated from each other by 10 nm or more. In all the combinations of the cases of selecting the four types of the above-mentioned four or more types of the compounds, it is enough that only one combination satisfies the above-mentioned relationship. Satisfying the relationship in the wavelength range makes it possible to shield the layer from external light widely falling within a broad wavelength range and therefore makes it possible to exhibit lightfastness. From the viewpoint of shielding the layer from external light falling within a wide wavelength range, the separation is preferably by 20 nm or more, more preferably by 30 nm or more. Regarding the way of counting the number of the types of the compounds, the number of the compounds having different structures is counted, and isomers of a compound are to be counted as one type of the compound. The upper limit of the types of the compounds is generally 10 or less, preferably 8 or less, more preferably 6 or less, from the viewpoint of the electric characteristics and the image characteristics of the layer.

In order that the entire surface of the charge transport layer could exhibit the light-shielding effect, it is desirable that the compounds exist uniformly in the layer. In the exposure process inside the image formation device, for preventing the exposure light to the charge-generating substance from scattering, it is desirable that the compounds dissolve in the charge transport layer. From these viewpoints, it is desirable that the compounds are dissolved in the coating liquid prepared by dissolving the charge transport layer in an organic solvent.

Of the range of the maximum absorption wavelengths that the four or more types of the compounds have, the lower limit is 300 nm or more, and the upper limit is 600 nm or less. From the viewpoint of blocking light of a shorter wavelength having higher energy, the upper limit is preferably 500 nm or less. For the case of the laminate-type photoreceptor to be used in a digital electrophotographic device, and when a compound having a maximum absorption wavelength in a wavelength range longer than 600 nm is contained in the layer in the photoreceptor of the type, the compound would shield the layer from the light of which the maximum exposure wavelength range falls within a range of from 650 nm to 900 nm or so, but the light falling within the range is used as the light for writing in many electrophotographic devices, and in the case, charge generation would be retarded in the charge generation layer. On the other hand, in a wavelength range shorter than 300 nm, the binder resin, the charge-transporting substance or the antioxidant to be used in the charge transport layer would have absorption, and therefore in the case, the light-shielding agent incorporated in the layer could hardly exhibit the light-resisting effect thereof.

The above-mentioned four or more types of the compounds are not specifically defined in point of the structure and the like thereof so far as they each have at least one maximum absorption wavelength in the wavelength range of from 300 nm to 600 nm, but of the four or more types of the compounds, three or more types are preferably any of hydrazone derivatives represented by the following formula (I), butadiene derivatives represented by the formula (II), monoazo derivatives represented by the formula (III), diphenoquinone derivatives represented by the formula (IV), naphthoquinone derivatives represented by the formula (V), azo derivatives represented by the formula (VI), arylamine derivatives represented by the formula (VII) and arylamine derivatives represented by the formula (VIII). The compounds for use in the present invention may have charge transportability.

[Chem. 9]

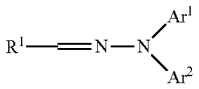

(I)

(In the formula (I), $Ar^1$ and $Ar^2$ each independently represent any of an aryl group, an alkoxy group or a hydrogen atom optionally having a substituent; and $R^1$ represents a substituent having from 12 to 30 carbon atoms.)

In $Ar^1$ and $Ar^2$, the carbon number of the aryl group is 30 or less, preferably 20 or less, more preferably 15 or less. Also preferably, the carbon number is 6 or more. Concretely, there are mentioned a phenyl group, a naphthyl group, an anthranyl group, etc.; and of those, especially preferred is a phenyl group.

In $Ar^1$ and $Ar^2$, the carbon number of the alkoxy group is 10 or less, preferably 5 or less, more preferably 4 or less. There are mentioned a linear alkoxy group such as a methoxy group, an ethoxy group, an n-propoxy group, an n-butoxy group, etc.; a branched alkoxy group such as an isopropoxy group an ethylhexyloxy group, etc.; a cyclic alkoxy group such as a cyclohexyloxy group, etc.; an alkoxy group having a fluorine atom, such as a trifluoromethoxy group, a pentafluoroethoxy group, a 1,1,1-trifluoroethoxy group, etc. Preferred is a linear or branched alkoxy group; and more preferred are a methoxy group, an ethoxy group, and an isopropoxy group. The substituent that $Ar^1$ and $Ar^2$ may have includes an alkyl group, an aryl group, an alkoxy group, a halogen atom, etc. Concretely, as the alkyl group there are mentioned a linear alkyl group such as a methyl group, an ethyl group, an n-propyl group, an n-butyl group, etc.; a branched alkyl group such as an isopropyl group, an ethylhexyl group, etc.; and a cyclic alkyl group such as a cyclohexyl group, etc. As the aryl group and the alkoxy group, the above-mentioned ones are mentioned. As the halogen atom, there are mentioned a fluorine atom, a chlorine atom, a bromine atom, etc. From the viewpoint of production, preferably, the substituent is absent or is an alkyl group.

$R^1$ represents a substituent having from 12 to 30 carbon atoms, and is not specifically defined since the hydrazone skeleton defines the absorption wavelength. For this, there are mentioned an alkyl group, an aryl group, an alkoxy group, a halogen atom as well as substituents derived from these.

[Chem. 10]

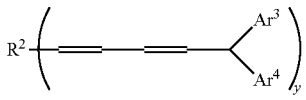

(II)

(In the formula (II), $Ar^3$ and $Ar^4$ each independently represent an aryl group, an alkoxy group or a hydrogen atom optionally having a substituent; $R^2$ represents a substituent having from 18 to 70 carbon atoms; and y indicates an integer of from 1 to 3.)

To $Ar^3$ and $Ar^4$, those mentioned hereinabove for $Ar^1$ and $Ar^2$ apply. $R^2$ is a substituent having from 18 to 70 carbon atoms, and is not specifically defined since the butadiene skeleton defines the absorption wavelength. For this, there are mentioned an alkyl group, an aryl group, an alkoxy group, a halogen atom as well as substituents derived from these. From the viewpoint the electric characteristics and the solubility of the compound, y is preferably 1 or 2.

[Chem.. 11]

(III)

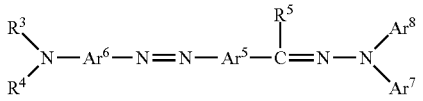

(In the formula (III), $Ar^5$ and $Ar^6$ each represent an arylene group; $Ar^7$ and $Ar^8$ each independently represent an aryl group or an alkoxy group optionally having a substituent; $R^3$ to $R^5$ each independently represent a hydrogen atom, an alkyl group, an alkoxy group, or an aryl group optionally having a substituent.)

In $Ar^5$ and $Ar^6$, the carbon number of the arylene group is 30 or less, preferably 20 or less, more preferably 15 or less. Also preferably, the carbon number is 6 or more. Concretely, as their examples, there are mentioned a phenylene group, a biphenylene group, a naphthylene group, an anthrylene group and a phenanthrylene group. Of those, in consideration of the characteristics of the electrophotographic photoreceptor, preferred are a phenylene group and a naphthylene group, and more preferred is a phenylene group. To $Ar^7$ and $Ar^8$, those mentioned hereinabove for $Ar^1$ and $Ar^2$ apply.

In $R^3$ to $R^5$, those mentioned hereinabove for $Ar^1$ and $Ar^2$ apply to the aryl group each independently optionally having a substituent. The carbon number of the alkyl group is 10 or less, preferably 5 or less, more preferably 4 or less. Concretely, there are mentioned a linear alkyl group such as a methyl group, an ethyl group, an n-propyl group, an n-butyl group, etc.; a branched alkyl group such as an isopropyl group, an ethylhexyl group, etc.; and a cyclic alkyl group such as a cyclohexyl group, etc. Preferred are a methyl group, an ethyl group, and an n-propyl group. The carbon number of the alkoxy group is 10 or less, preferably 5 or less, more preferably 4 or less. There are mentioned a linear alkoxy group such as a methoxy group, an ethoxy group, an n-propoxy group, an n-butoxy group, etc.; a branched alkoxy group such as an isopropoxy group an ethylhexyloxy group, etc.; a cyclic alkoxy group such as a cyclohexyloxy group, etc.; an alkoxy group having a fluorine atom, such as a trifluoromethoxy group, a pentafluoroethoxy group, a 1,1,1-trifluoroethoxy group, etc. Preferred is a linear or branched alkoxy group; and more preferred are a methoxy group, an ethoxy group, and an isopropoxy group.

[Chem. 12]

(IV)

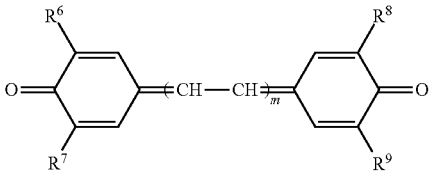

(In the formula (IV), $R^6$ to $R^9$ each independently represents an alkyl group having 6 or less carbon atoms; and m indicates 0 or 1.)

In the formula (IV), $R^6$ to $R^9$ each independently represents an alkyl group having 6 or less carbon atoms. The carbon number of $R^6$ to $R^9$ is 6 or less, preferably 4 or less. Also preferably, the carbon number is 1 or more. Examples of the alkyl group include a linear alkyl group such as a methyl group, an ethyl group, a propyl group, etc.; and a branched alkyl group such as an isopropyl group, a tert-butyl group, a tert-pentyl group, etc. Preferably, all of $R^6$ to $R^9$ are tert-butyl groups, or from the viewpoint of the solubility of the compound, two of these are methyl groups and the other two thereof are tert-butyl groups.

m indicates 0 or 1, and from the viewpoint of easiness in production of the compound, m is preferably 0.

[Chem. 13]

(V)

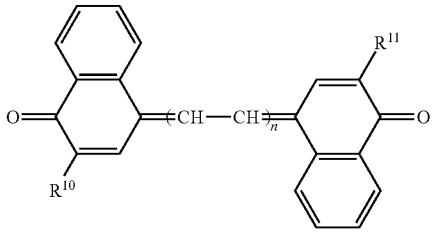

(In the formula (V), $R^{10}$ and $R^{11}$ each independently represent an alkyl group having 6 or less carbon atoms; and n indicates 0 or 1.)

In the formula (V), $R^{10}$ and $R^{11}$ each independently represent an alkyl group having 6 or less carbon atoms. The carbon number of $R^{10}$ and $R^{11}$ is 6 or less, preferably 4 or less. Examples of the alkyl group include a linear alkyl group such as a methyl group, an ethyl group, a propyl group, etc.; and a branched alkyl group such as an isopropyl group, a tert-butyl group, a tert-pentyl group, etc. Of those, preferred is a branched alkyl group; and above all, more preferred are a tert-butyl group and a tert-pentyl group. n indicates 0 or 1, and from the viewpoint of easiness in production of the compound, n is preferably 0.

[Chem. 14]

(VI)

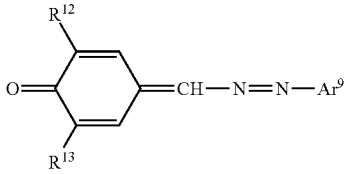

(In the formula (VI), $R^{12}$ and $R^{13}$ each independently represent an alkyl group having 6 or less carbon atoms; and $Ar^9$ represents an aryl group having 30 or less carbon atoms and optionally having a substituent.)

In the formula (VI), $R^{12}$ and $R^{13}$ each independently represent an alkyl group having 6 or less carbon atoms. The carbon number of $R^{12}$ and $R^{13}$ is 6 or less, preferably 4 or less. Also preferably, the carbon number is 1 or more. Examples of the alkyl group include a linear alkyl group such as a methyl group, an ethyl group, a propyl group, etc.; and a branched alkyl group such as an isopropyl group, a tert-butyl group, a tert-pentyl group, etc. Of those, preferred is a branched alkyl group, and above all, more preferred is a tert-butyl group.

$Ar^9$ represents an aryl group having 30 or less carbon atoms and optionally having a substituent. The carbon number of $Ar^9$ is 30 or less, preferably 20 or less, more preferably 15 or less. Concretely, there are mentioned a phenyl group, a naphthyl group, an anthranyl group, etc. Of those, most preferred is a phenyl group. The substituent that $Ar^9$ may have includes an alkyl group, a nitro group, a halogeno group, etc.; and of those, preferred is a halogeno group, and more preferred is a chloro group.

[Chem. 15]

(VII)

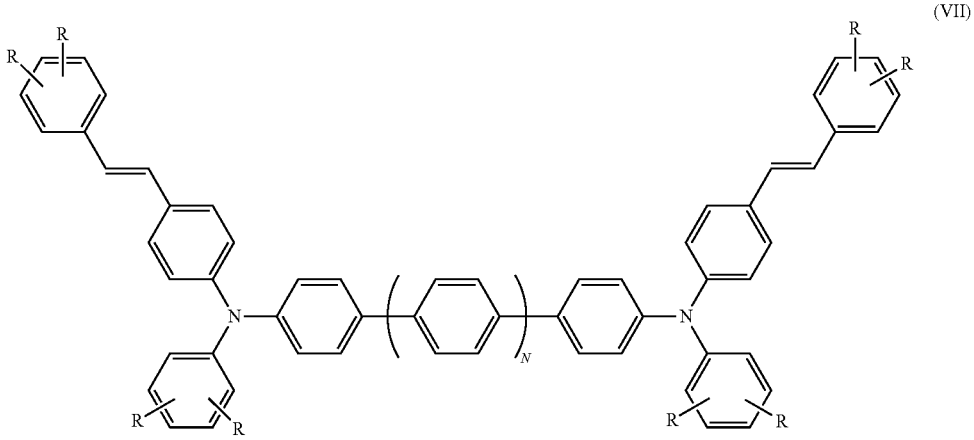

(In the formula (VII), R each independently represents a hydrogen atom, an alkyl group, an alkoxy group, or a phenyl group; and N indicates 0 or 1.)

In the formula (VII), R each independently represents a hydrogen atom, an alkyl group, an alkoxy group, or a phenyl group. The alkyl group is preferably a linear or branched alkyl group, and the carbon number thereof is preferably from 1 to 6. Above all, preferred are a methyl group, an ethyl group and a propyl group. The alkoxy group is preferably linear or branched alkoxy group. Above all, more preferred are a methoxy group, an ethoxy group, and an isopropoxy group. N indicates 0 or 1, and is preferably 0. In particular, R is preferably a hydrogen atom or an alkyl group, and preferably, the compound has an alkyl group at the ortho-position or the para-position relative to the nitrogen atom or the vinyl group therein.

In the formula (VIII), R' each independently represents a hydrogen atom, an alkyl group, an alkoxy group, or a phenyl group. The alkyl group is preferably a linear or branched alkyl group, and the carbon number thereof is preferably from 1 to 6. Above all, more preferred are a methyl group, an ethyl group and a propyl group. The alkoxy group is preferably a linear or branched alkoxy group. Above all, more preferred are a methoxy group, an ethoxy group and an isopropoxy group. In particular, R' is preferably a hydrogen atom or an alkyl group. Preferably, the compound has an alkyl group at the ortho-position or the para-position relative to the nitrogen atom or the vinyl group therein.

Specific examples of preferred structures are shown below. In the structural formulae, Me, Et and nBu each indicate a methyl group, an ethyl group and an n-butyl group, respectively.

[Chem. 16]

(VIII)

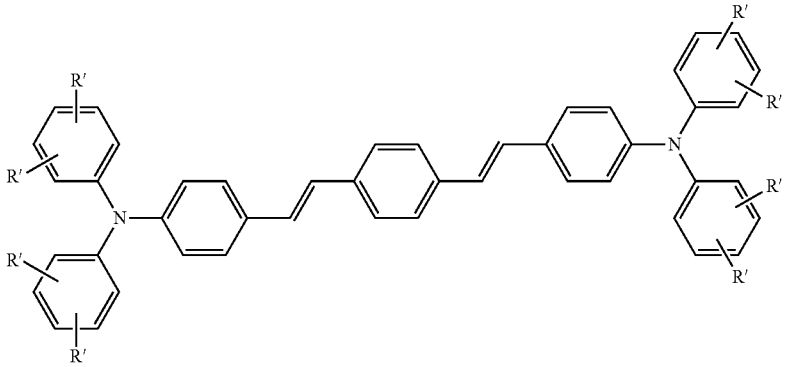

(In the formula (VIII), R' each independently represents a hydrogen atom, an alkyl group, an alkoxy group, or a phenyl group.)

[Chem. 17]
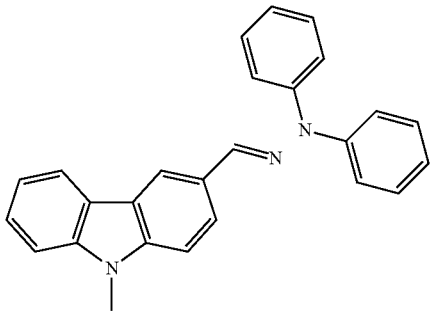
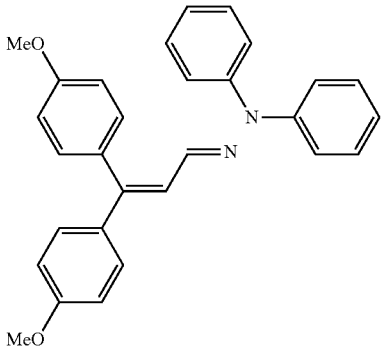
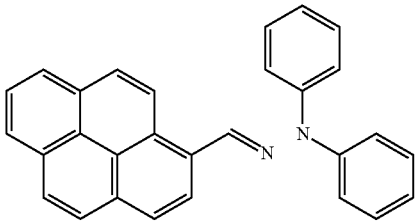
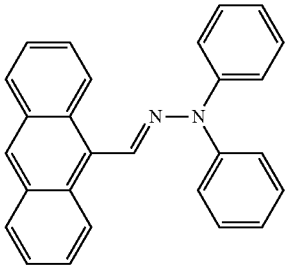
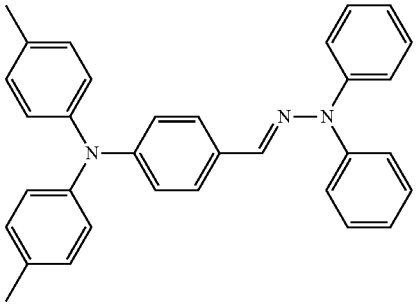
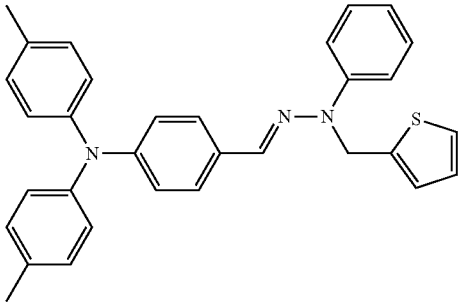
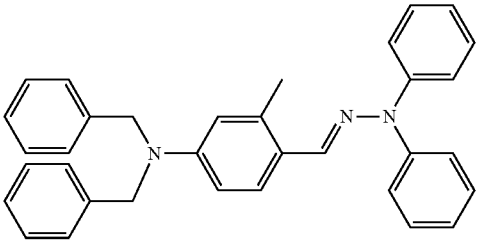
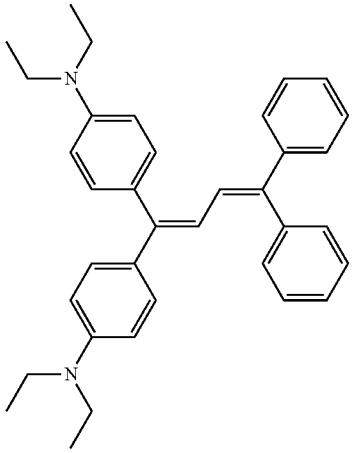
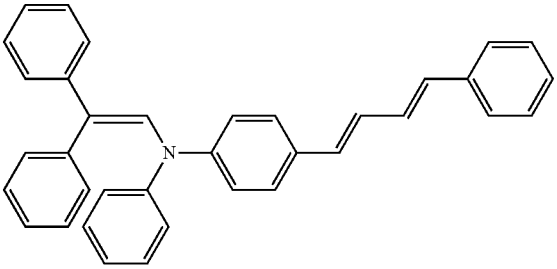

-continued
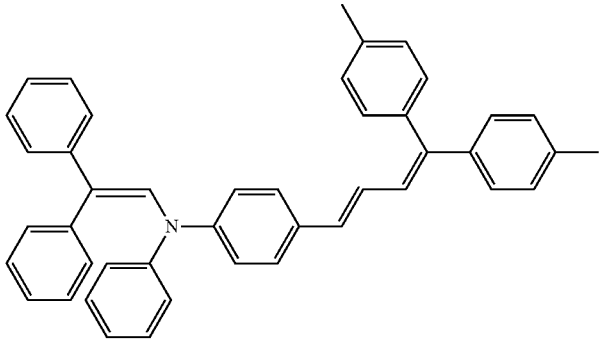
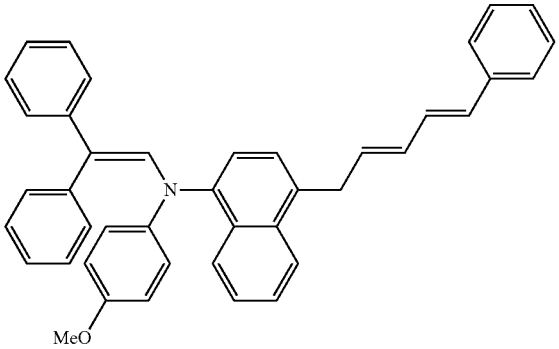
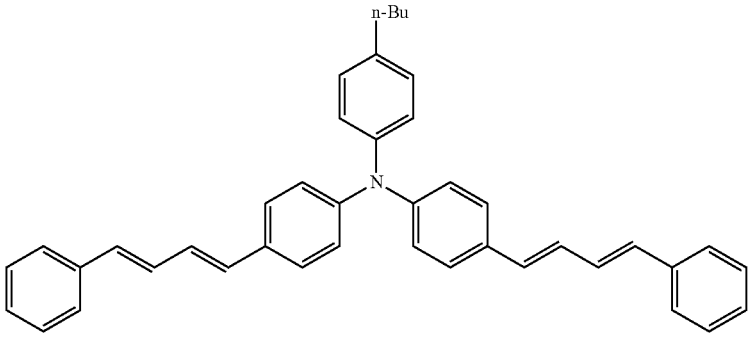
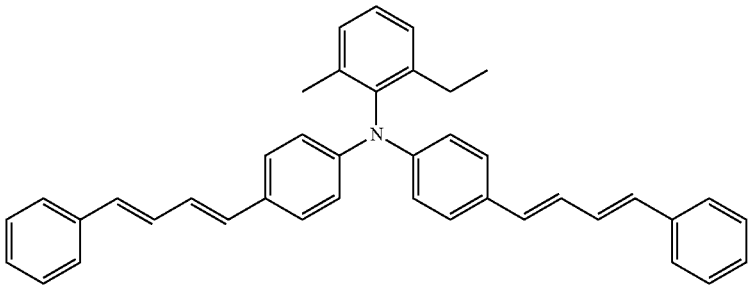
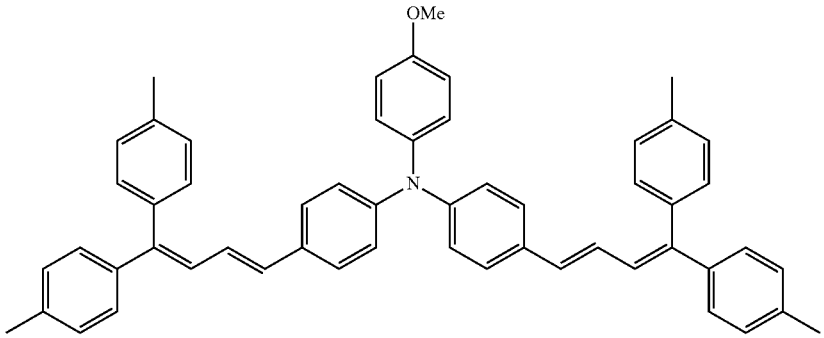
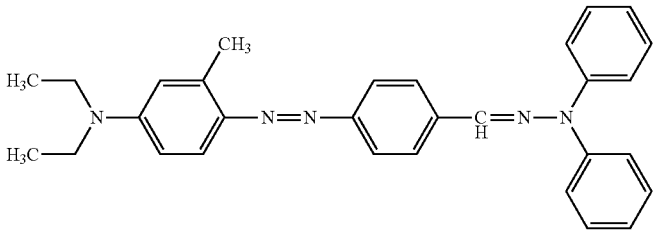

-continued
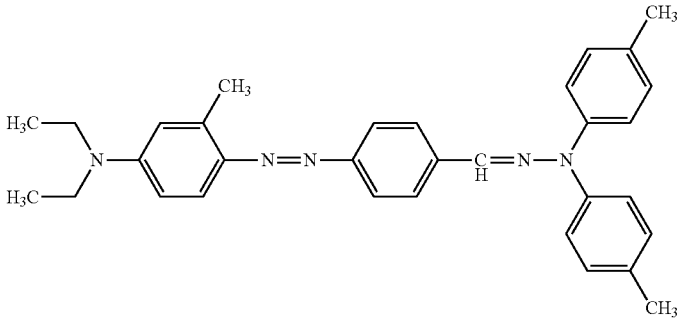
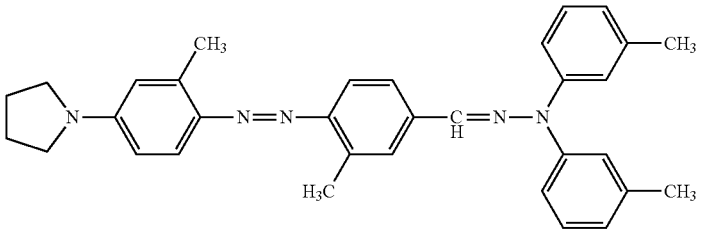
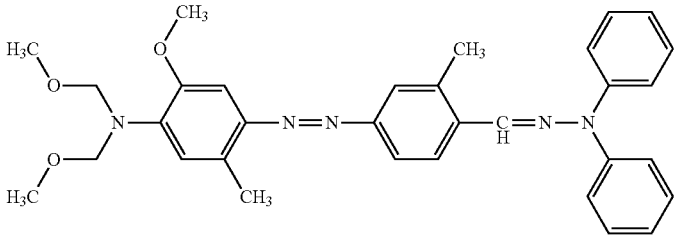
[Chem. 18]
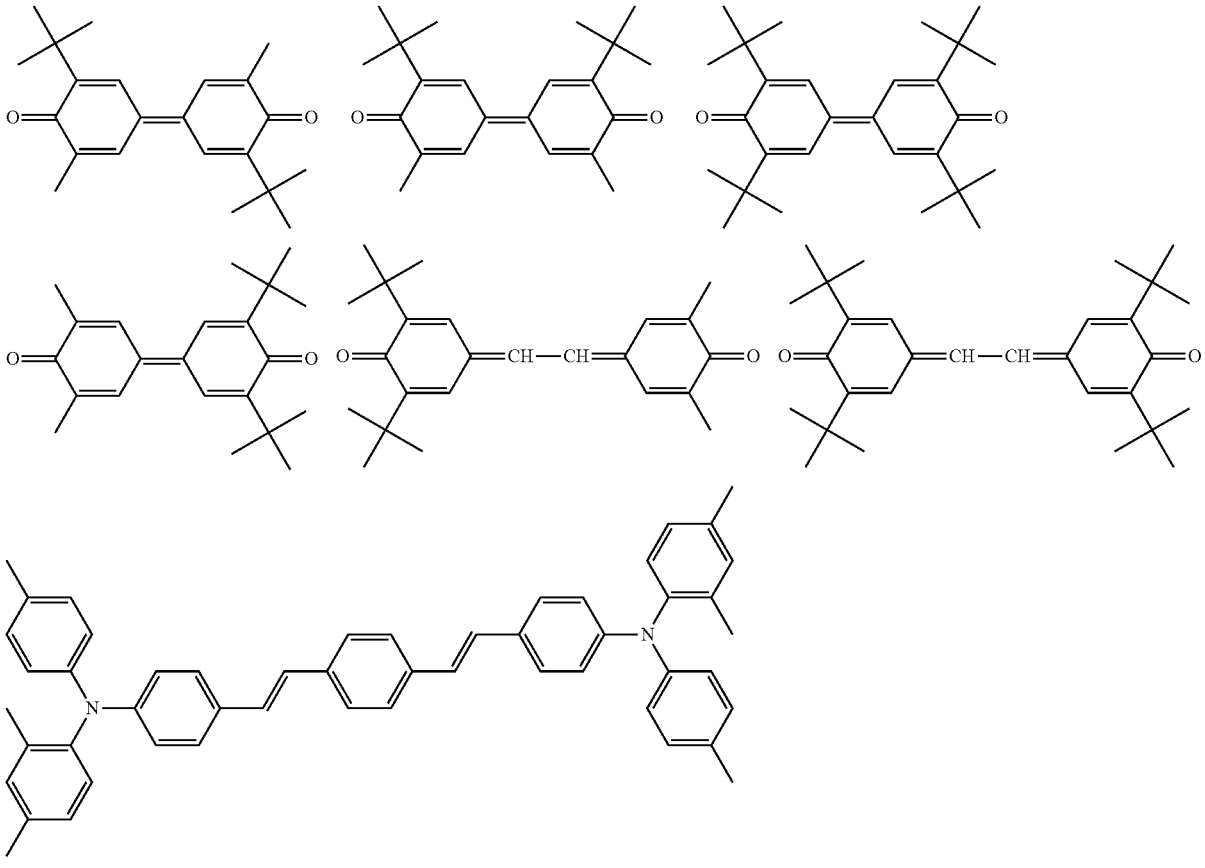

-continued
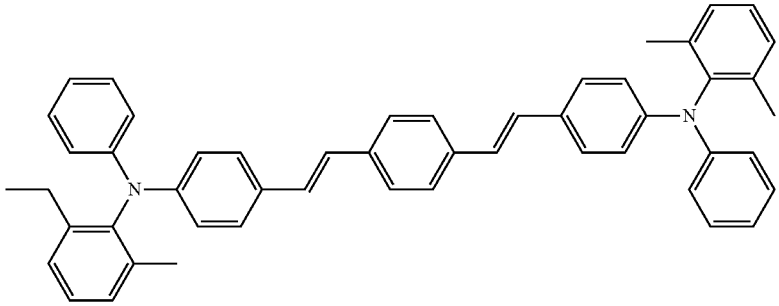
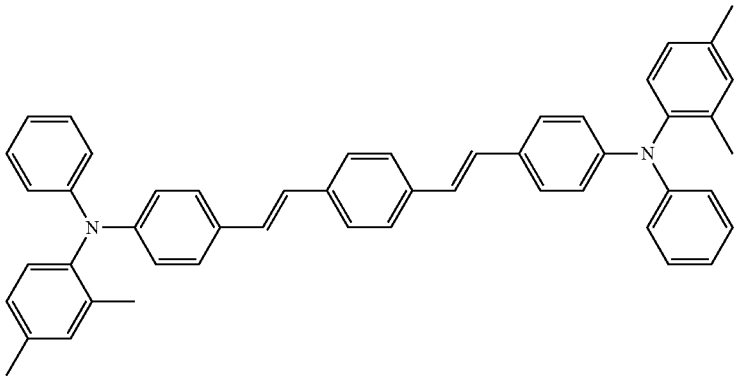
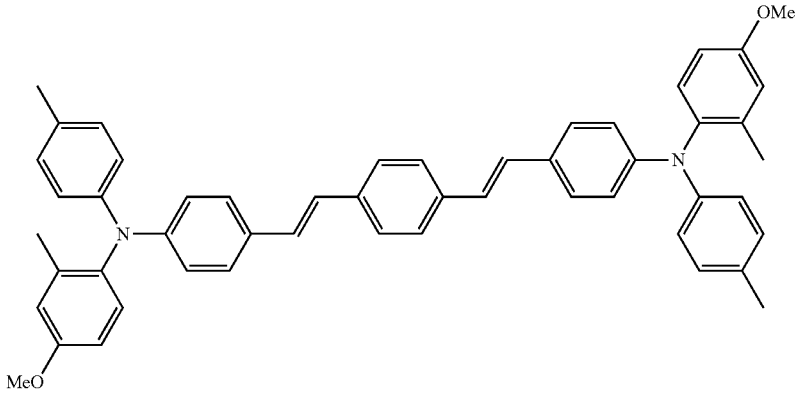
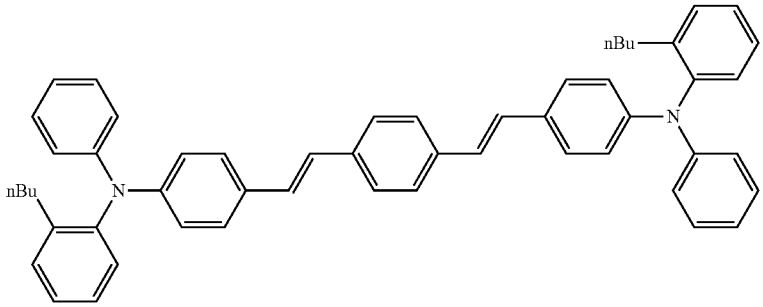

-continued
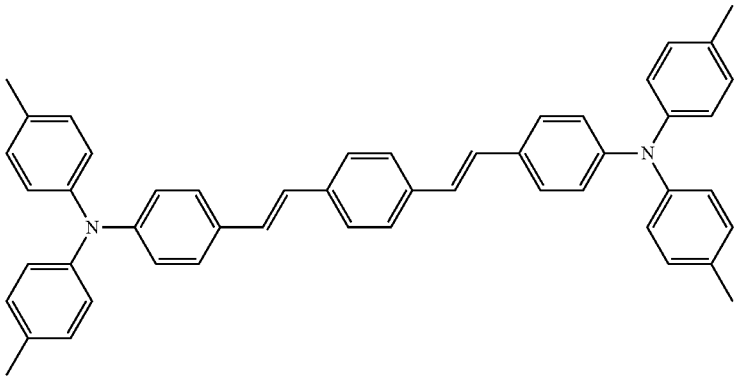
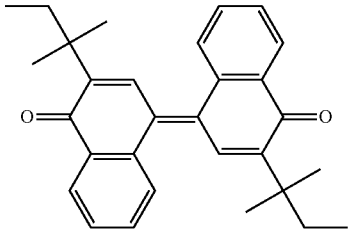
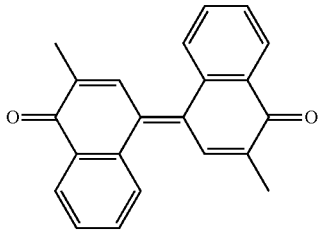
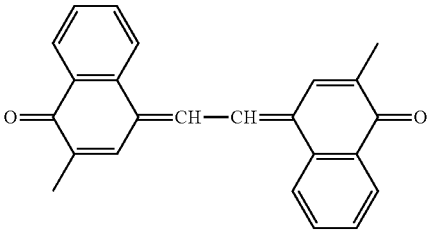
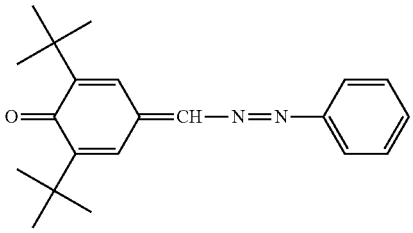
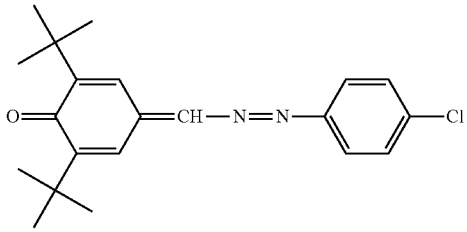
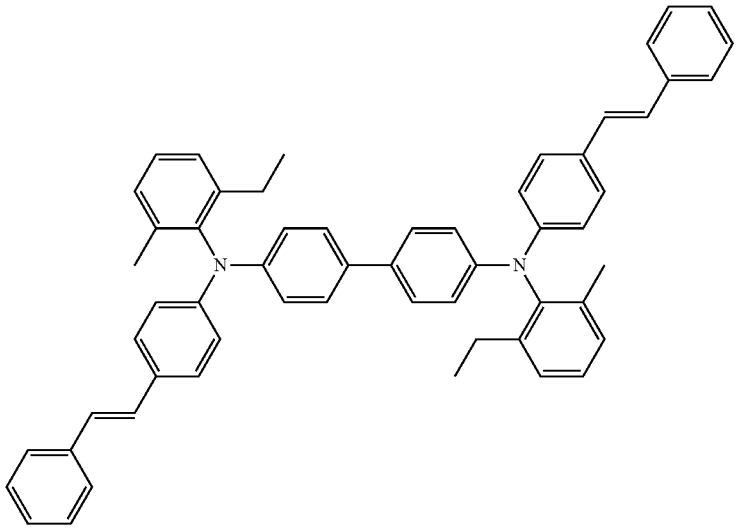

-continued
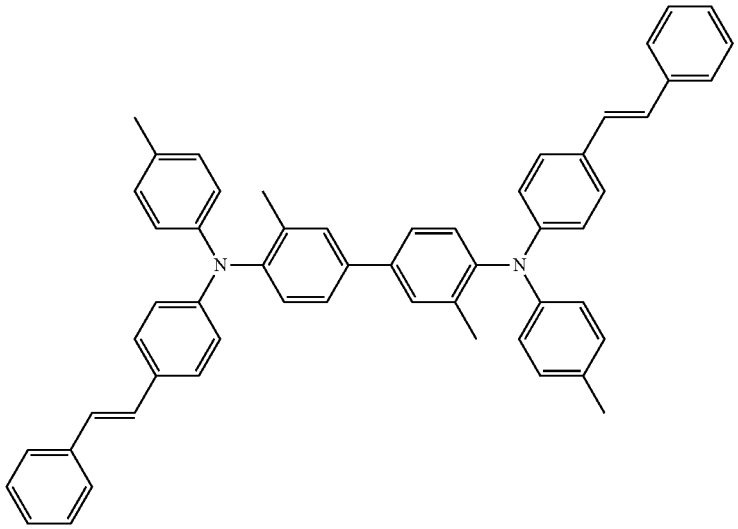
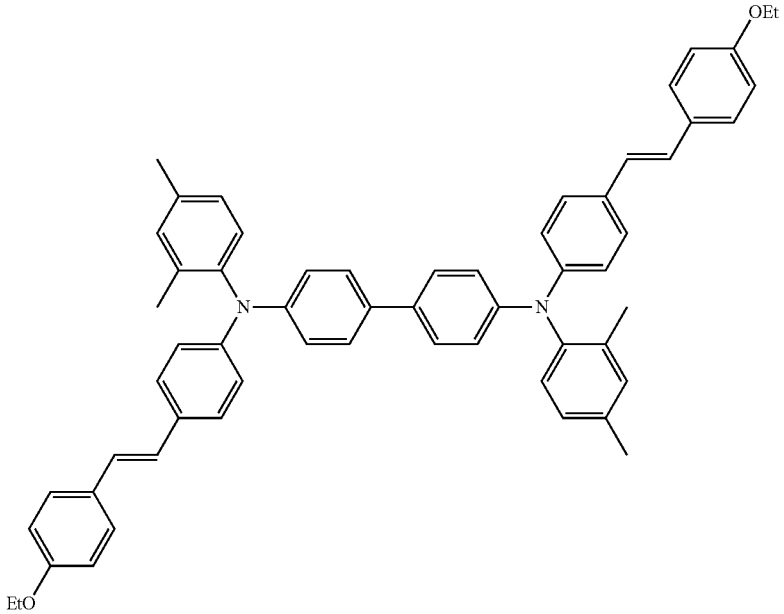
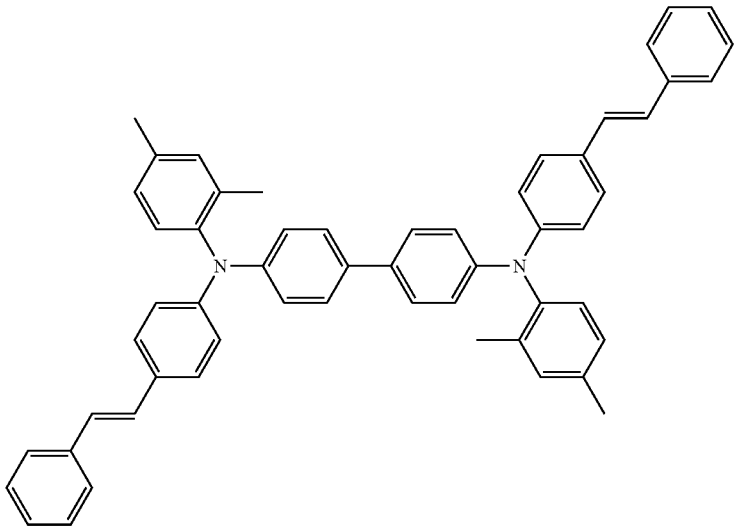

-continued

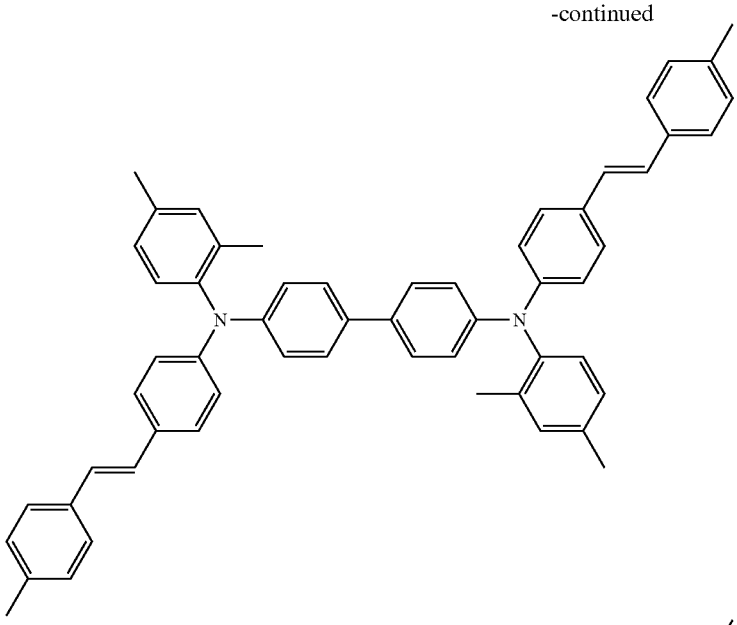

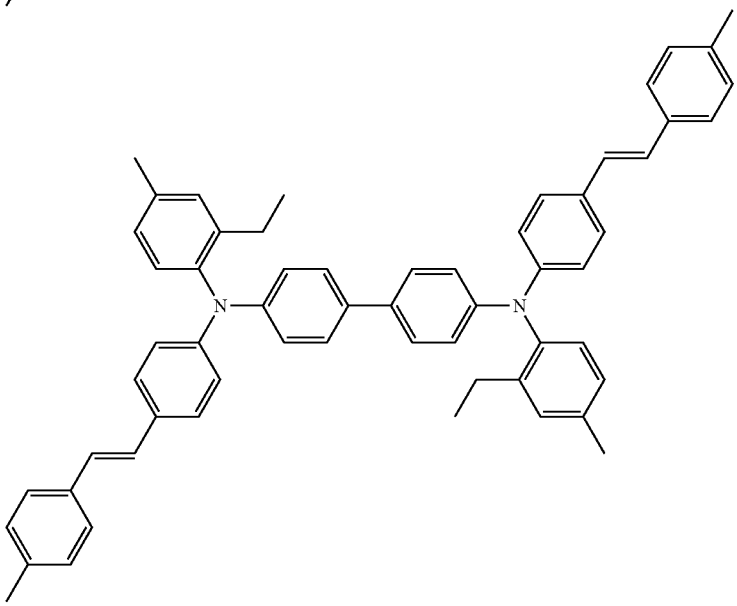

The content of each compound may be any arbitrary one not significantly detracting from the advantageous effects of the present invention. However, when the content is too small, then the light-shielding effect would reduce. Accordingly, the content is 0.01 parts by mass or more, preferably 0.5 parts by mass or more relative to 100 parts by mass of the binder in the charge transport layer. On the other hand, when the compound is contained too excessively, then the glass transition point (Tg) of the layer would lower too much and the abrasion resistance thereof would worsen. In general, the content is 200 parts by mass or less, preferably 150 parts by mass or less.

Of the above-mentioned four or more types of the compounds, the lower limit of the content of the compound of which the content is the smallest in the charge transport layer is, from the viewpoint of the light shieldability of the layer, 0.01 parts by mass or more, preferably 0.5 parts by mass or more relative to 100 parts by mass of the binder resin in the charge transport layer, and from the viewpoint of the electric characteristics of the layer, the upper limit of the content is preferably 20 parts by mass or less.

Of the above-mentioned four or more types of the compounds, the content of each of the other compounds than the compound having the largest content of the four or more types of the compounds in the charge transport layer is, from the viewpoint of the light shieldability of the layer, generally 0.01 parts by mass or more, preferably 0.5 parts by mass or more relative to 100 parts by mass of the binder resin in the charge transport layer, and from the viewpoint of the electric characteristics thereof, the upper limit of the content is preferably 20 parts by mass or less.

From the viewpoint of satisfying both the electric characteristics and the lightfastness, it is desirable that, of the above-mentioned four or more types of the compounds, the layer contains at least a compound of which the maximum absorption wavelength falls within a wavelength range of from 300 to 420 nm and a compound of which the maximum absorption wavelength falls within a wavelength range of from 440 to 500 nm.

From the viewpoint of the lightfastness, it is desirable that, of the above-mentioned four or more types of the compounds, the layer contains at least a compound of which the maximum absorption wavelength falls within a wavelength range of from 300 to 350 nm and a compound of which the maximum absorption wavelength falls within a wavelength range of from 450 to 500 nm.

From the viewpoint of both the electric characteristics and the lightfastness, it is desirable that, of the above-mentioned four or more types of the compounds, at least two compounds are the following first and second compounds.

First compound: at least the maximum absorption wavelength of the compound falls within a wavelength range of from 330 to 420 nm and the amount of the compound is from 20 to 70 parts by mass relative to 100 parts by mass of the binder resin in the charge transport layer.

Second compound: at least the maximum absorption wavelength of the compound falls within a wavelength range of from 440 to 500 nm and the amount of the compound is from 0.1 to 10 parts by mass relative to 100 parts by mass of the binder resin in the charge transport layer.

<Charge-Transporting Substance>

The amount of the charge-transporting substance to be used in the layer is any arbitrary one not significantly detracting from the advantageous effects of the present invention. However, when the amount is too small, it would be disadvantageous for charge transport and the electric characteristics of the layer would worsen. Accordingly, the amount is generally 25 parts by mass or more, preferably 40 parts by mass or more relative to 100 parts by mass of the binder resin in the charge transport layer. On the other hand, when the amount is too large, then the glass transition point (Tg) of the layer would lower too much and the abrasion resistance thereof would worsen. In general, the amount is 200 parts by mass or less, preferably 150 parts by mass or less, more preferably 100 parts by mass or less.

As the charge-transporting substance, any known charge-transporting substance may be used here, and the type thereof is not specifically defined. For example, preferred are carbazole derivatives, hydrazone compounds, aromatic amine derivatives, enamine derivatives, butadiene derivatives, and those formed by bonding a plurality of these derivatives to each other. Specific examples of preferred structures of the charge-transporting substance are shown below.

[Chem. 19]

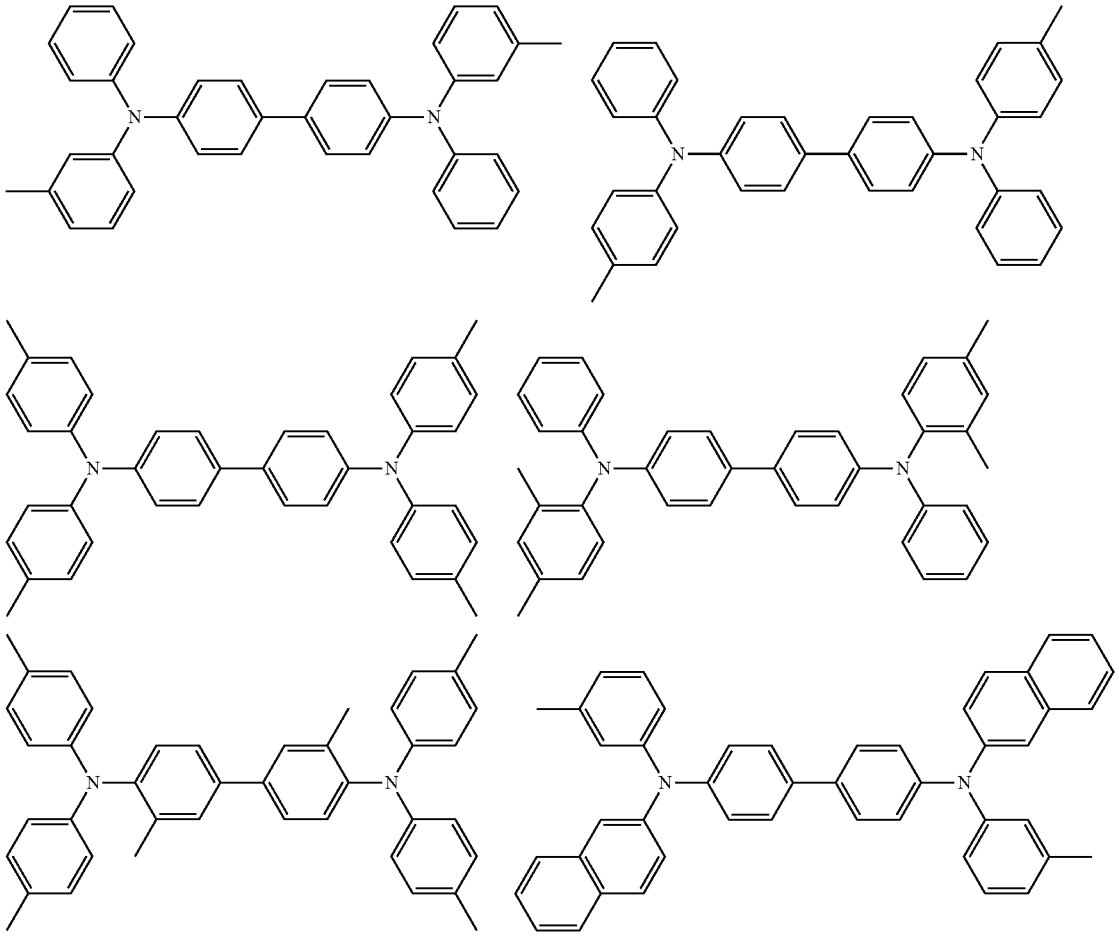

-continued
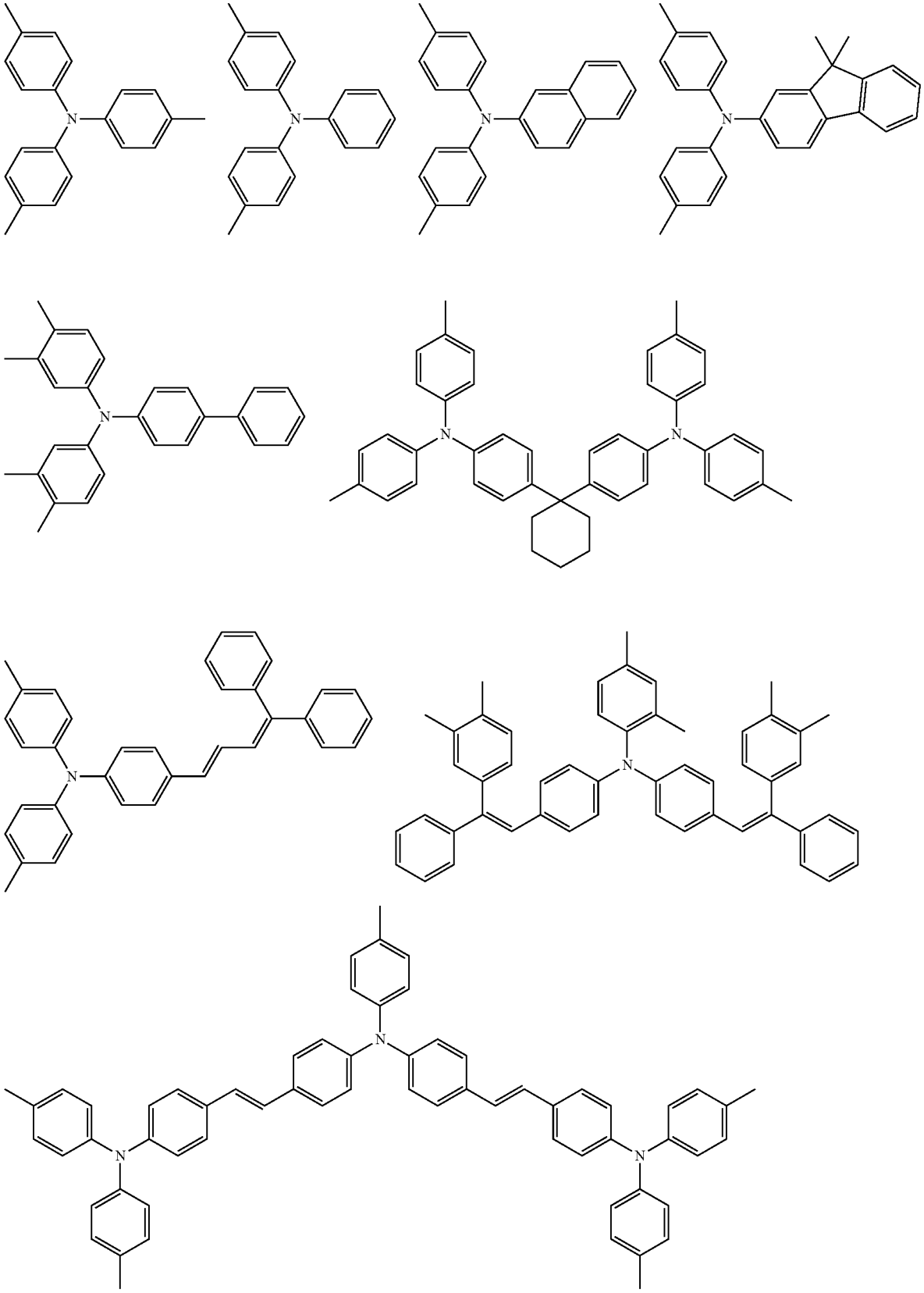

-continued

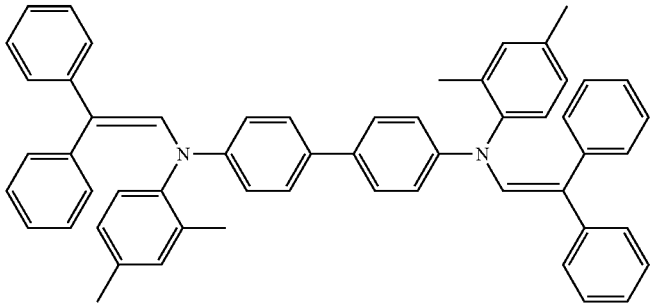

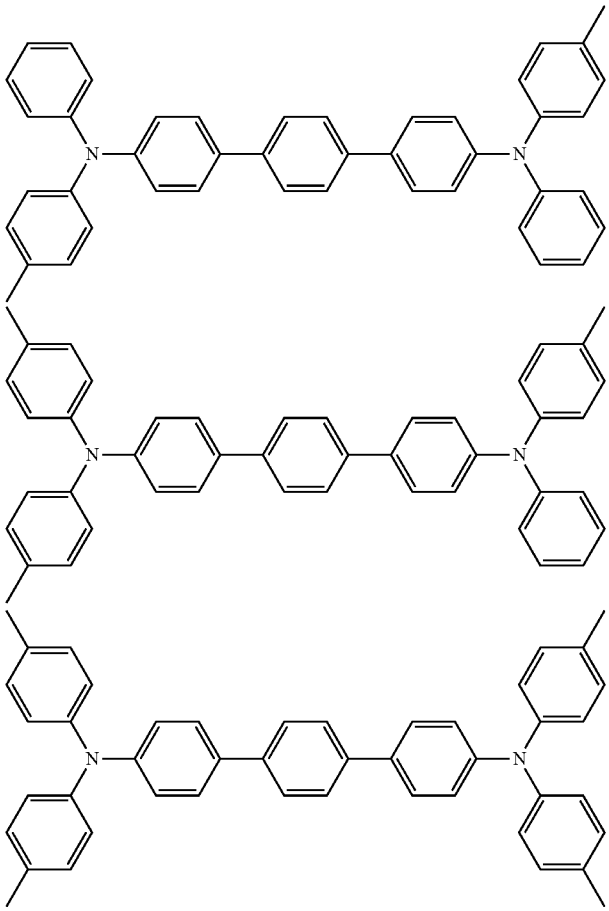

<Binder Resin>

Examples of the binder resin to be contained in the layer in the present invention include polycarbonate resins, polyarylate resins, polyester resins, butadiene resins, styrene resins, vinyl acetate resins, vinyl chloride resins, acrylate resins, methacrylate resins, vinyl alcohol resins, polymers and copolymers of vinyl compounds such as ethyl vinyl ether and the like, polyvinyl butyral resins, polyvinyl formal resins, partially-modified polyvinyl acetals, polyamide resins, polyimide resins, polyurethane resins, cellulose ester resins, phenoxy resins, silicone resins, silicone-alkyd resins, poly-N-vinylcarbazole resins, etc. Before use herein, these binder resins may be crosslinked by heat, light or the like using a suitable curing agent, or may be modified with a silicon reagent. Above all, from the viewpoint of the electric characteristics and the exposure light permeability, preferred are polycarbonate resins and polyarylate resins. Before use herein, these resins may be crosslinked by heat, light or the like using a suitable curing agent. Any one type or two or more types of these binder resins may be used here either singly or as combined in any desired manner. Specific examples of preferred structures of the binder resin are shown

[Chem. 20]

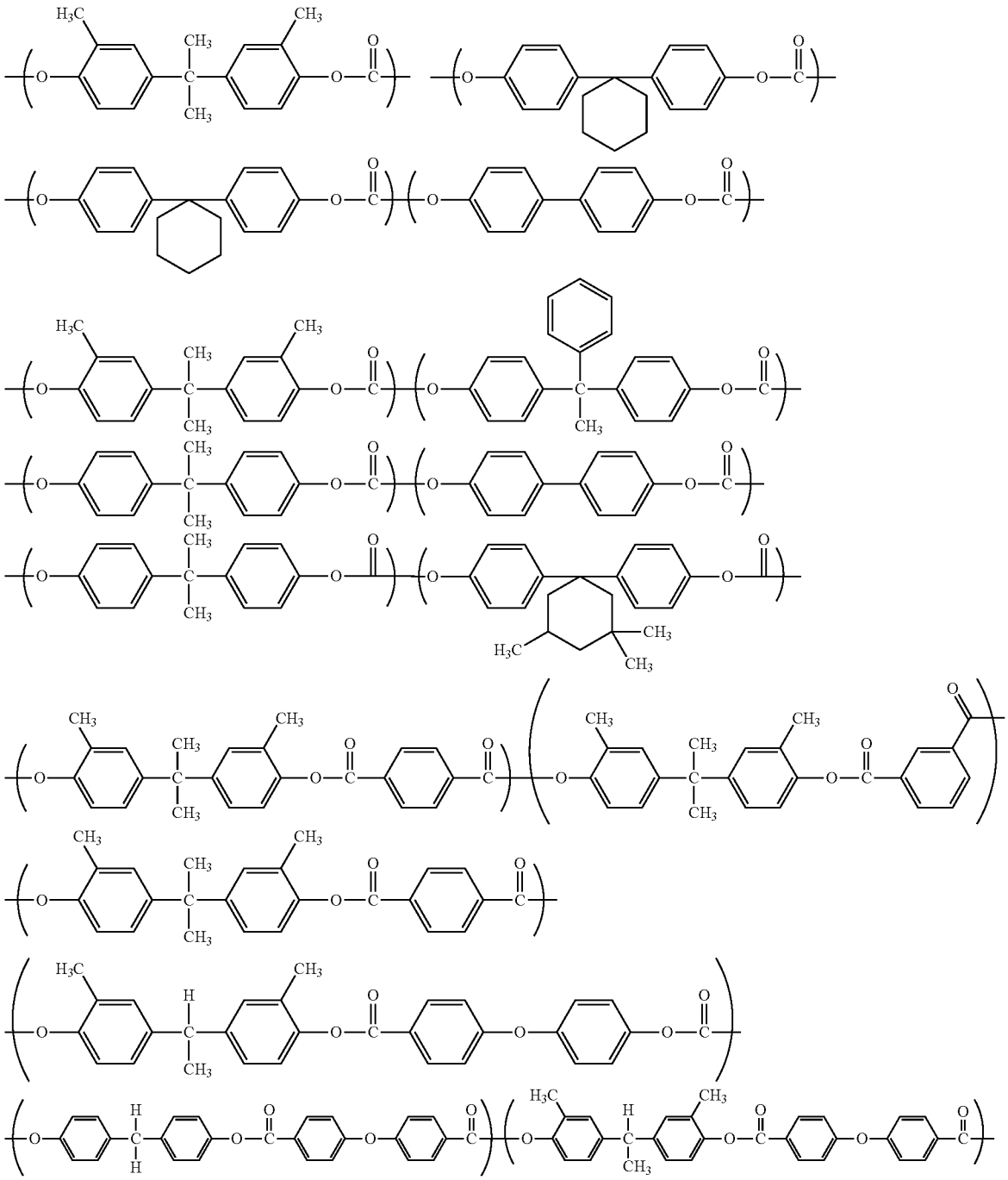

<Other Constituent Components>

Further, the photosensitive layer may contain various additives. These additives are used for improving the film formability, the flexibility, the mechanical strength and the like, and for example, there are mentioned a plasticizer, an antioxidant, a residual potential controlling agent for controlling residual potential, a dispersion assistant for improving dispersion stability, a leveling agent for improving coatability (for example, silicone oil, fluorine oil, etc.), a surfactant, etc. One alone or two or more types of additives may be used here either singly or as combined in any desired manner and in any desired ratio.

[III-3. Film Thickness]

The film thickness of the photosensitive layer in the photoreceptor of the present invention is not specifically defined, and may be any arbitrary one not significantly detracting from the advantageous effects of the present invention. In the case of a laminate-type photoreceptor, the thickness of the charge generation layer is preferably from 0.1 μm to 1 μm, more preferably from 0.2 μm to 0.8 μm; and the thickness of the charge transport layer is generally 5 μm or more, preferably 10 μm or more, and is generally 40 μm or less, preferably 35 um or less. Not limited to a single layer, the charge transport layer may be formed of two or more different layers.

[IV. Other Layers]

A protective layer may be provided on the photosensitive layer as an outermost surface layer. Suitable additives may be added to the protective layer. For example, there are mentioned resin particles of a fluororesin, a silicone resin, a crosslinked polystyrene resin or the like, and inorganic particles such as alumina particles, silica particles, etc. In case where the thickness of the protective layer is more than 1 μm ,the physical properties of the protective layer would control more strongly the surface mechanical properties of the photoreceptor, rather than the influence of the lower layer thereon, and therefore in the case, any known material may be used as the material to constitute the lower layer, photosensitive layer regardless of the range defined in the present invention.

[V. Method for Formation of Layers]

The method for forming the undercoat layer, the photosensitive layer and the protective layer is not specifically defined. For example, any known method is employable here; the material to be contained in the layer to be formed is dissolved or dispersed in a solvent to prepare a coating liquid, and the coating liquid is sequentially applied onto a conductive support, directly or via any other layer. After the coating, the solvent is removed by drying to form the photosensitive layer.

In this case, the coating method is not limited and may be any arbitrary one. For example, employable here are a dip coating method, a spray coating method, a nozzle coating method, a bar coating method, a roll coating method, a blade coating method, etc. Of those, preferred is a dip coating method from the viewpoint of the productivity. One alone of those coating methods may be employed singly, or two or more those methods may be combined.

[VI. Image Formation Device, Process Cartridge]

Next described are embodiments of the image formation device using the electrophotographic photoreceptor of the present invention (the image formation device of the present invention) with reference to FIG. 1 showing the substantial constitution of the device. However, the present invention is not limited to the following embodiments, and may be carried out in any desired modification not overstepping the scope and the spirit of the present invention.

In FIG. 1, 1 is a drum-type photoreceptor, which is rotationally driven at a predetermined peripheral speed in the arrowed direction. The photoreceptor 1 receives uniform charge at a positive or negative, predetermined potential on the surface thereof from the charging device 2 in the rotational process, and then in the exposure part 3, this is exposed to light for latent image formation by the image exposure means.

The formed electrostatic latent image is then toner-developed in the development device 4, and the toner-developed image is sequentially transferred to the transferred medium (paper or the like) fed from a sheet feeder by the corona transfer device 5. In FIG. 1, the development device 4 comprises a development tank 41, an agitator 42, a feed roller 43, a development roller 44 and a control member 45, and is so designed that a toner T is stored inside the development tank 41. If desired, a refill device (not shown) for refilling the toner T may be attached to the development device 4. The refill device is so designed that the toner T can be supplied from a container such as a bottle, a cartridge or the like.

The image-transferred transferred medium is then conveyed to the fixation device 7, in which the image is fixed thereon, and printed out of the machine. The fixation device 7 comprises an upper fixation member (fixation roller) 71 and a lower fixation member (fixation roller) 72, and a heating device 73 is arranged inside the fixation member 71 or 72. FIG. 1 shows a case where the heating device 73 is arranged inside the upper fixation member 71. For the upper fixation member 71 and the lower fixation member 72, usable here are known thermal fixation members such as a fixation roll in which the metallic core tube of stainless, aluminium or the like is covered with a silicone rubber, as well as a fixation roll further covered with a Teflon (registered trademark) resin, a fixation sheet, etc. In addition, the fixation members 71 and 72 may be so designed that they can supply a release agent such as a silicone oil or the like for improving the releasability of the medium, or may be so designed that they could forcedly impart pressure to each other by a spring or the like.

The toner transferred on the recording paper P is, while running between the upper fixation member 71 that has been heated up to a predetermined temperature and the lower fixation member 72, heated to be in a molten state, and after having passed through it and cooled, the toner is fixed on the recording paper P. The surface of the photoreceptor 1 is, after image transfer, cleaned up to remove the remaining toner by the cleaning device 6, and then neutralized by the neutralization device to be cleaned up for the next image formation thereon.

In using the electrophotographic photoreceptor of the present invention, as the charger, usable is a corona charger such as a corotron, scorotron or the like, as well as a direct charging means of bringing the direct charging member thereof under voltage impression into contact with the surface of the photoreceptor for charging the surface. Examples of the direct charging means include contact chargers such as a charger roller, a charger brush, etc. As the direct charging means, employable here are both one accompanied by aerial discharge and one for injection charging not accompanied by aerial discharge. As the voltage to be applied in charging, a direct current alone may be used, but also usable is a superimposed voltage of a direct current and an alternate current.

In the photoreceptor using the charge-transporting substance represented the formula (I) in the present application, when contact charging, especially contact charging by direct current (DC) voltage application is employed, there may often occur a problem of image density unevenness owing to exposure to external light. This is considered because, as compared with a scorotron system, the photoreceptor of the type is poor in the charging performance, and therefore surface potential control could not always be attained owing to insufficiency in surface charge impartation, and as a result, the influence of the in-plane unevenness of the surface resistance could not be canceled and would readily appear on the formed image. Consequently, in a contact charging system, especially in a direct current contact charging system, the merit of using the photoreceptor of the present invention is remarkable.

For the exposure, usable here is a halogen lamp, a fluorescent lamp, a laser (semiconductor, He—Ne), LED, an in-photoreceptor exposure system or the like. Preferred is use of a digital electrophotographic system with laser, LED, optical shutter array or the like. Regarding the wavelength, usable is a monochromatic light at 780 nm, as well as a monochromatic light in a range of from 600 to 700 nm near to a short wavelength side.

For the development process, employable is a dry development system or a wet development system of one-component insulating toner development, one-component conductive toner development, two-component magnetic brush development of the like. As the toner, employable is a ground tonner, as well as a chemical toner prepared in a suspension granulation method, a suspension polymerization method or an emulsion polymerization aggregation method. In particular, as the chemical toner, used here are small particles having a small particle size of from 4 to 8 μm or so, and the form thereof may be a nearly spherical one or may be a non-spherical one such as a potato-like one. The polymerization toner is excellent in charging uniformity and transferability, and is favorably used for forming high-quality images.

As the transfer process, employable is an electrostatic transfer method of corona transfer, roller transfer, belt transfer or the like, as well as a pressure transfer method, or an adhesive transfer method. For the fixation, usable is any of hot roller fixation, flash fixation, oven fixation, pressure fixation, IH fixation, belt fixation, IHF fixation, etc. One alone of these fixation modes may be used here, or two or more those fixation modes may be combined.

For the cleaning, usable is any of a brush cleaner, a magnetic brush cleaner, an electrostatic brush cleaner, a magnetic roller cleaner, a blade cleaner, etc.

The neutralization step is omitted in many cases, but when the step is taken, a fluorescent lamp, LED or the like may be used therein. The intensity of the light for neutralization is generally 3 times or more of the exposure energy of the exposure light. In addition to these processes, the image formation device may take an additional process of a pre-exposure step and a subsidiary charging step.

The cartridge using the electrophotographic photoreceptor of the present invention may comprise the above-mentioned photoreceptor 1, and at least a part of the group consisting of the charging device 2, the exposure device 3, the development device 4 and the cleaning device 6.

In the present invention, plural members of the constituent elements of the above-mentioned drum-type photoreceptor 1, the charging device 2, the development device 4 and the cleaning device 6 may be united and combined with a drum cartridge, and the drum cartridge may be so designed as to be detachable to a body of an electrophotographic apparatus such as a copier, a laser beam printer, etc. For example, at least one of the charging device 2, the development device 4 and the cleaning device 6 is supported by a cartridge, as integrated with the drum-type photoreceptor 1 to provide a process cartridge. In addition, the electrophotographic photoreceptor of the present invention is applicable to an image formation device equipped with the charging device 2, the exposure part 3, the development device 4 and the cleaning device 6.

EXAMPLES

The present invention is described in more detail hereinunder, with reference to Examples and Comparative Examples given below. The following Examples are for describing in detail the present invention, and the present invention is not restricted to the following Examples, not overstepping the scope and the spirit thereof. Unless otherwise specifically indicated, "part" used in Examples is "part by mass".

Example 1

Aluminium oxide particles having a mean primary particle size of 13 nm (Nippon Aerosil's Aluminum Oxide C) were ultrasonically dispersed in a mixed solvent of methanol/1-propanol to prepare a dispersion slurry of aluminium oxide. The dispersion slurry, a mixed solvent of methanol/1-propanol (ratio by mass, 7/3), and pellets of a copolyamide comprising ε-caprolactam [compound represented by the following formula (A)]/bis(4-amino-3-methylcyclohexyl) methane (compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a compositional molar ratio of 60%/15%/5%/15%/5% were mixed with stirring under heat to dissolve the polyamide pellets, and then ultrasonically dispersed to give a dispersion for undercoat layer containing aluminium oxide/copolyamide in a ratio by mass of 1/1 and having a solid concentration of 8.0%.

[Chem. 21]

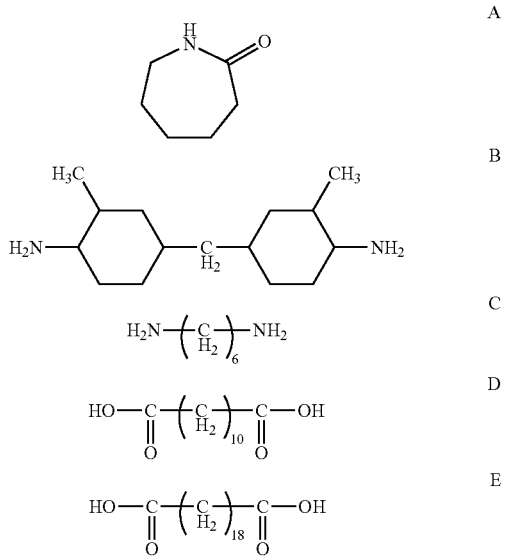

Thus obtained, the undercoat layer-forming coating liquid was applied onto an aluminium-deposited polyethylene terephthalate sheet (thickness 75 μm) using a wire bar in such a manner that the thickness of the coating film could be, after dried, 1.2 μm, and then dried to provide an undercoat layer.

Figure 2:
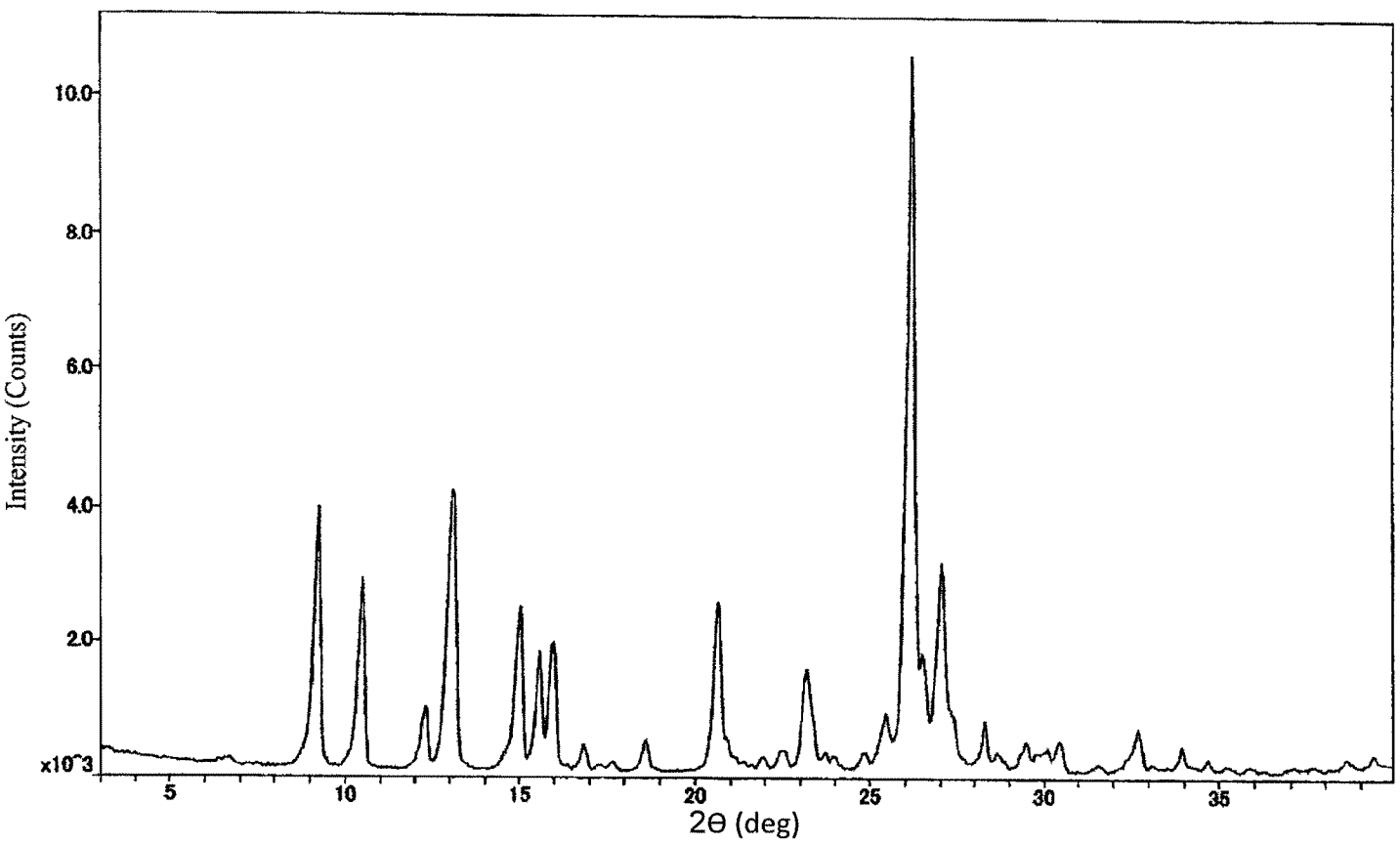
FIG. 2 shows a powdery X-ray diffraction spectrum with CuKα characteristic X-ray of oxytitanium phthalocyanine used in Example 1.

As a charge-generating substance, 200 parts of oxytitanium phthalocyanine having a powdery X-ray diffraction spectral pattern with CuKα characteristic X-ray, as shown in FIG. 2, and 280 parts of 1,2-dimethoxyethane were mixed, ground in a sand grind mill for 2 hours for dispersion through atomization. Subsequently, 400 parts of a 2.5% 1,2-dimethoxyethane solution of polyvinyl butyral (Denki Kagaku Kogyo's trade name "Denka Butyral" #6000C), and 170 parts of 1,2-dimethoxyethane were mixed to prepare a dispersion. The dispersion was applied onto the above-mentioned undercoat layer using a bar coater in such a manner that the thickness of the coating layer could be 0.4 μm, thereby forming a charge generation layer thereon.

Next, a liquid (coating liquid I-1) prepared by dissolving 100 parts of a binder resin having the following structure (viscosity-average molecular weight: 40000), 60 parts of a compound (1) having the following structure, 0.5 parts of a compound (2), 0.5 parts of a compound (3), 0.5 parts of a compound (4), 8 parts of an antioxidant having the following structure and, as a leveling agent, 0.05 parts of silicone oil (Shin-Etsu Silicone's KF96-10CS) in 550 parts of a mixed solvent of tetrahydrofuran/toluene (7/3) was applied on the film, dried at 125° C. for 20 minutes, thereby forming a charge transport layer having a thickness, after dried, of 25 μm to provide a photoreceptor.

<Binder Resin>

[Chem. 22]

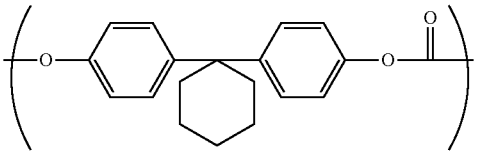

<Compounds>

[Chem. 23]

(1)

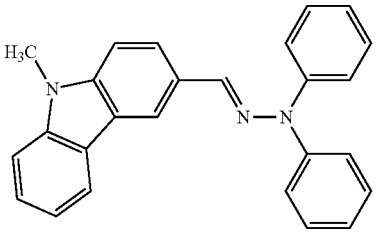

[Chem. 24]

(2)

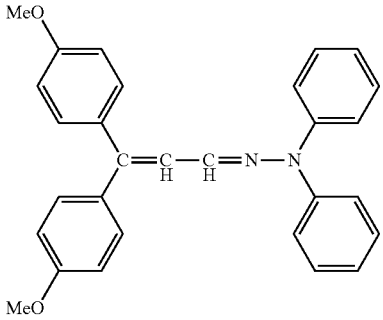

[Chem. 25]

(3)

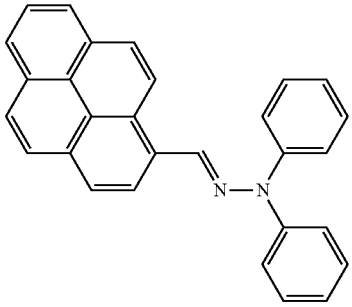

-continued

[Chem. 26]

(4)

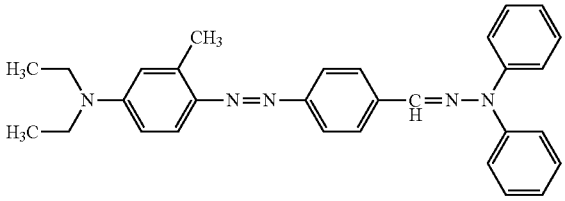

<Antioxidant>

[Chem. 27]

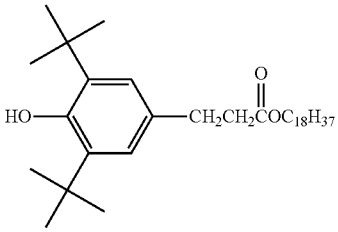

Example 2

A photoreceptor was produced in the same manner as in Example 1, except that the content of the compounds (2), (3) and (4) was 1 part each.

Example 3

A photoreceptor was produced in the same manner as in Example 1, except that the content of the compounds (2), (3) and (4) was 5 parts each.

Example 4

A photoreceptor was produced in the same manner as in Example 1, except that the content of the compounds (2), (3) and (4) was 10 parts each.

Example 5

A photoreceptor was produced in the same manner as in Example 1, except that the content of the compounds (2), (3) and (4) was 20 parts each.

Example 6

A photoreceptor was produced in the same manner as in Example 1, except that compounds (5) and (6) were used in place of the compounds (3) and (4).

[Chem. 28]

(5)

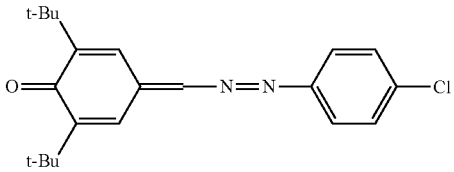

-continued

[Chem. 29]

(6)

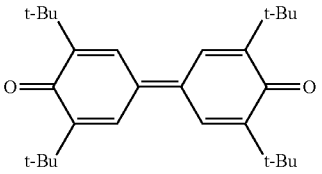

Example 7

A photoreceptor was produced in the same manner as in Example 1, except that compounds (7) and (8) were used in place of the compounds (3) and (4).

[Chem. 30]

(7)

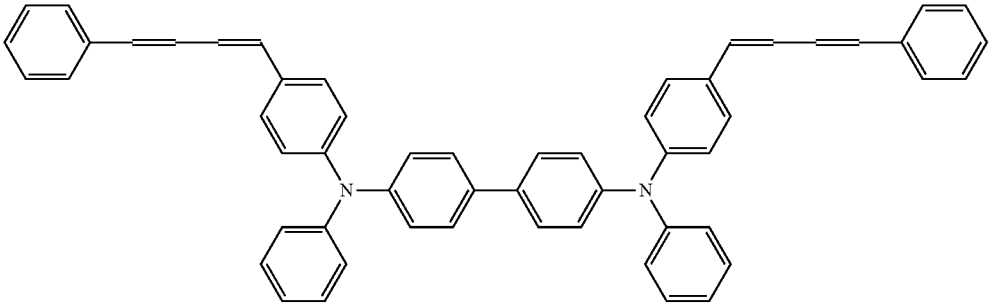

[Chem. 31]

(8)

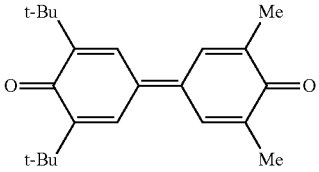

Example 8

A photoreceptor was produced in the same manner as in Example 1, except that compounds (7) and (8) were used in place of the compounds (2) and (4).

[Chem. 32]

(9)

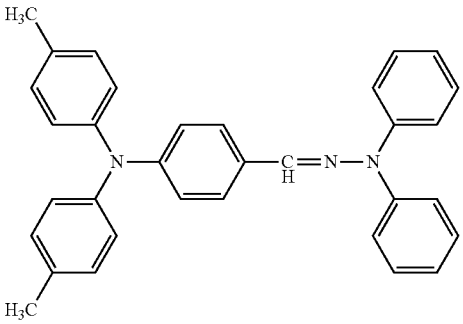

Example 9

A photoreceptor was produced in the same manner as in Example 1, except that the content of the compounds (2), (3) and (4) was 0.01 parts each.

Example 10

A photoreceptor was produced in the same manner as in Example 1, except that 40 parts of a compound (10) was used in place of 60 parts of the compound (1), and compounds (6), (12) and (13) were used in place of the compounds (2), (3) and (4).

[Chem. 33]

(10)

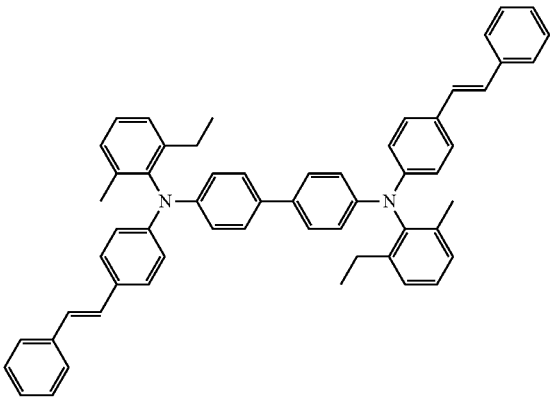

[Chem. 34]

(12)

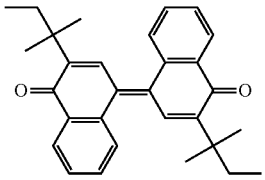

[Chem. 35]

(13)

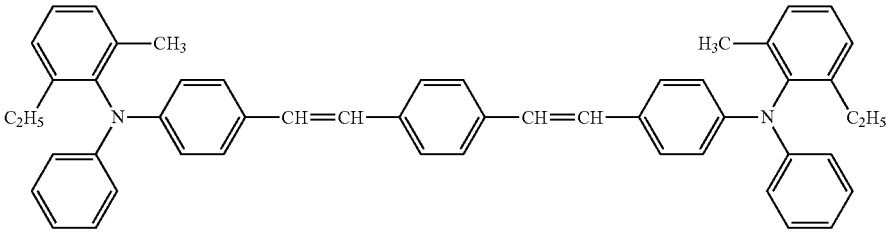

Example 11

A photoreceptor was produced in the same manner as in Example 10, except that the compound (4) was used in place of the compound (13).

Example 12

A photoreceptor was produced in the same manner as in Example 11, except that a compound (11) was used in place of the compound (10).

[Chem. 36]

(11)

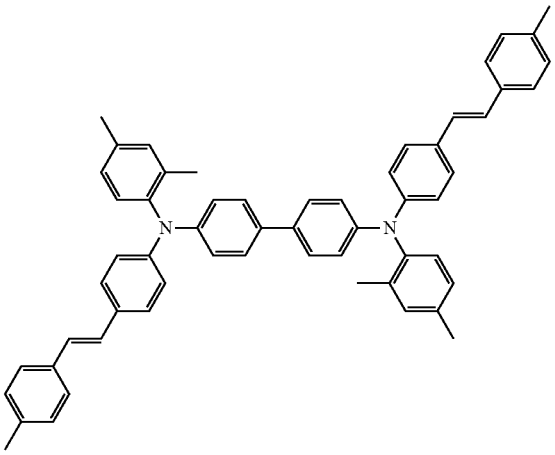

Example 13

A photoreceptor was produced in the same manner as in Example 12, except that 0.5 parts of the compound (9) was further incorporated.

Example 14

A photoreceptor was produced in the same manner as in Example 11, except that 60 parts of a compound (14) was used in place of 40 parts of the compound (11).

[Chem. 37]

(14)

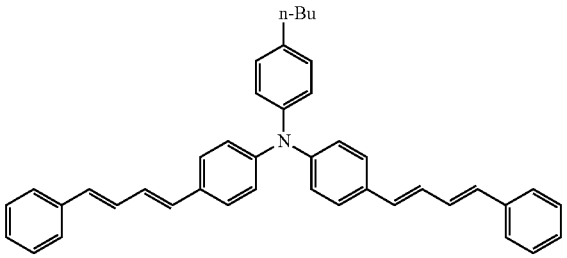

Example 15

A photoreceptor was produced in the same manner as in Example 14, except that the compound (13) was used in place of the compound (4).

Comparative Example 1

A photoreceptor was produced in the same manner as in Example 1, except that the compound (4) was not contained.

Comparative Example 2

A photoreceptor was produced in the same manner as in Example 1, except that the compounds (2), (3) and (4) were not contained.

Comparative Example 3

A photoreceptor was produced in the same manner as in Example 1, except that the compound (9) was used in place of the compound (4).

Comparative Example 4

A photoreceptor was produced in the same manner as in Example 1, except that the content of the compound (3) was 1 part and the compound (4) was not contained.

Comparative Example 5

A photoreceptor was produced in the same manner as in Example 6, except that the compound (8) was used in place of the compound (5).

Comparative Example 6

A photoreceptor was produced in the same manner as in Comparative Example 1, except that the compound (4) was used in place of the compound (3).

Comparative Example 7

A photoreceptor was produced in the same manner as in Example 9, except that the compound (4) was not contained.

Comparative Example 8

A photoreceptor was produced in the same manner as in Example 10, except that the compound (13) was not contained.

Comparative Example 9

A photoreceptor was produced in the same manner as in Comparative Example 8, except that the compound (11) was used in place of the compound (10).

Comparative Example 10

A photoreceptor was produced in the same manner as in Comparative Example 9, except that 0.5 parts of the compound (9) was further contained.

Comparative Example 11

A photoreceptor was produced in the same manner as in Comparative Example 8, except that 60 parts of the compound (14) was used in place of 40 parts of the compound (10).

Comparative Example 12

A photoreceptor was produced in the same manner as in Comparative Example 11, except that 0.5 parts of the compound (3) was further contained.

Table 1 shows the maximum absorption wavelength falling within a wavelength range of from 300 nm to 600 nm in the electron absorption spectrum of each of the compounds (1) to (14) in a 0.001 mass % tetrahydrofuran solution at 25° C.

[Evaluation of Lightfastness]

The photoreceptor obtained in the above-mentioned Examples and Comparative Examples was set in an electrophotographic characteristics evaluation device constructed according to the measurement standard by the Society of Electrophotography of Japan (described in Basis and Application of Electrophotography Continued, edited by the Society of Electrophotography of Japan, Corona Publishing, pp. 404-405), in which the electric characteristics thereof were evaluated in a cycle of charging, exposure, potential measurement and neutralization. The photoreceptor was so charged that the initial surface potential thereof under the condition of 25° C. and 50% humidity, V0 could be −700 V, then exposed to a monochromatic light at 780 nm that had been derived from the light of a halogen lamp through an interference filter, and the surface potential was measured at an arbitrary exposure amount. In this, the time from the exposure to the potential measurement was 194 milliseconds, and the surface potential after irradiation at 2.6 $\mu J/cm^2$ was referred to as VL. Subsequently, the photoreceptor was exposed to the light of a white fluorescent lamp (National's FL20SW) for 10 minutes in such a controlled manner that the light intensity on the surface of the photoreceptor could be 2000 lux, and thereafter the photoreceptor was measured in the same manner as previously. Table 2 and Table 3 show the potential change ΔV0 and ΔVL before and after irradiation with the white fluorescent lamp, relative to the initial surface potential V0 and VL of the photoreceptor. On the other hand, the photoreceptor was irradiated for 60 minutes, for which, however, the light from the white fluorescent lamp (National's FL20SW) was so controlled that the light intensity on the surface of the photoreceptor could be 4000 lux, and thereafter the photoreceptor was measured in the same manner as above. The results are shown in Table 4, Table 5 and Table 6.

In the following Table 2 to Table 6, the negative value means that the absolute value of the potential after photoirradiation became smaller relative to the absolute value of the potential before photoirradiation, and the positive value means that, on the contrary, the former became larger relative to the latter. The smaller absolute value of the change indicates that the potential changed little even after irradiation with a light having a high light intensity, or that is, the photoreceptor having such a smaller absolute value can be said to be excellent in lightfastness.

TABLE 1

| | Maximum Absorption Wavelength (nm) |
|---|---|
| Compound (1) | 340 |
| Compound (2) | 374 |
| Compound (3) | 407 |
| Compound (4) | 468 |
| Compound (5) | 402 |
| Compound (6) | 423 |
| Compound (7) | 393 |
| Compound (8) | 419 |
| Compound (9) | 380 |
| Compound (10) | 409 |

TABLE 1-continued

| | Maximum Absorption Wavelength (nm) |
|---|---|
| Compound (11) | 388 |
| Compound (12) | 484 |
| Compound (13) | 392 |
| Compound (14) | 411 |

TABLE 2

| | Four or More Types of Compounds (part by mass) | | | | Potential Change | |
|---|---|---|---|---|---|---|
| | 1 | 2 | 3 | 4 | ΔV0 (V) | ΔVL (V) |
| Example 1 | Compound (1) [60] | Compound (2) [0.5] | Compound (3) [0.5] | Compound (4) [0.5] | −2 | 36 |
| Example 2 | Compound (1) [60] | Compound (2) [1] | Compound (3) [1] | Compound (4) [1] | 4 | 11 |
| Example 3 | Compound (1) [60] | Compound (2) [5] | Compound (3) [5] | Compound (4) [5] | 4 | 0 |
| Example 4 | Compound (1) [60] | Compound (2) [10] | Compound (3) [10] | Compound (4) [10] | −1 | 0 |
| Example 5 | Compound (1) [60] | Compound (2) [20] | Compound (3) [20] | Compound (4) [20] | 5 | 0 |
| Example 6 | Compound (1) [60] | Compound (2) [0.5] | Compound (5) [0.5] | Compound (6) [0.5] | 7 | 61 |
| Example 7 | Compound (1) [60] | Compound (2) [0.5] | Compound (7) [0.5] | Compound (8) [0.5] | −1 | 95 |
| Example 8 | Compound (1) [60] | Compound (3) [0.5] | Compound (7) [0.5] | Compound (9) [0.5] | −7 | 89 |
| Comparative Example 1 | Compound (1) [60] | Compound (2) [0.5] | Compound (3) [0.5] | | 3 | 136 |
| Comparative Example 2 | Compound (1) [60] | | | | 7 | 365 |
| Comparative Example 3 | Compound (1) [60] | Compound (2) [0.5] | Compound (3) [0.5] | Compound (9) [0.5] | −1 | 125 |
| Comparative Example 4 | Compound (1) [60] | Compound (2) [0.5] | Compound (3) [1] | | 6 | 142 |
| Comparative Example 5 | Compound (1) [60] | Compound (2) [0.5] | Compound (6) [0.5] | Compound (8) [0.5] | 5 | 112 |
| Comparative Example 6 | Compound (1) [60] | Compound (2) [0.5] | Compound (4) [0.5] | | 7 | 290 |

TABLE 3

| | Four or More Types of Compounds (part by mass) | | | | Potential Change | |
|---|---|---|---|---|---|---|
| | 1 | 2 | 3 | 4 | ΔV0 (V) | ΔVL (V) |
| Example 9 | Compound (1) [60] | Compound (2) [0.01] | Compound (3) [0.01] | Compound (4) [0.01] | 5 | 180 |
| Comparative Example 7 | Compound (1) [60] | Compound (2) [0.01] | Compound (3) [0.01] | | −10 | 240 |

TABLE 4

| | Four or More Types of Compounds (part by mass) | | | | Potential Change | |
|---|---|---|---|---|---|---|
| | 1 | 2 | 3 | 4 | ΔV0 (V) | ΔVL (V) |
| Example 10 | Compound (6) [0.5] | Compound (10) [40] | Compound (12) [0.5] | Compound (13) [0.5] | 5 | 55 |
| Example 11 | Compound (4) [0.5] | Compound (6) [0.5] | Compound (10) [40] | Compound (12) [0.5] | −1 | 46 |
| Comparative Example 8 | Compound (6) [0.5] | Compound (10) [40] | Compound (12) [0.5] | | −3 | 91 |

TABLE 5

| | Four or More Types of Compounds (part by mass) | | | | | Potential Change | |
|---|---|---|---|---|---|---|---|
| | 1 | 2 | 3 | 4 | 5 | ΔV0 (V) | ΔVL (V) |
| Example 12 | Compound (4) [0.5] | Compound (6) [0.5] | Compound (11) [40] | Compound (12) [0.5] | | 1 | 18 |
| Example 13 | Compound (4) [0.5] | Compound (6) [0.5] | Compound (9) [0.5] | Compound (11) [40] | Compound (12) [0.5] | −4 | 20 |
| Comparative Example 9 | Compound (6) [0.5] | Compound (11) [40] | Compound (12) [0.5] | | | 2 | 46 |
| Comparative Example 10 | Compound (6) [0.5] | Compound (9) [0.5] | Compound (11) [40] | Compound (12) [0.5] | | −5 | 34 |

TABLE 6

| | Four or More Types of Compounds (part by mass) | | | | Potential Change | |
|---|---|---|---|---|---|---|
| | 1 | 2 | 3 | 4 | ΔV0 (V) | ΔVL (V) |
| Example 14 | Compound (4) [0.5] | Compound (6) [0.5] | Compound (12) [0.5] | Compound (14) [60] | −7 | 23 |
| Example 15 | Compound (6) [0.5] | Compound (12) [0.5] | Compound (13) [0.5] | Compound (14) [60] | 10 | 25 |
| Comparative Example 11 | Compound (6) [0.5] | Compound (12) [0.5] | Compound (14) [60] | | 5 | 50 |
| Comparative Example 12 | Compound (3) [0.5] | Compound (6) [0.5] | Compound (12) [0.5] | Compound (14) [60] | −12 | 50 |

Of the photoreceptors satisfying the requirements in the present invention, the absolute value of ΔVL that indicates the exposure potential change before and after optical fatigue is small, and it is known that the photoreceptors exhibit good lightfastness. Comparing Examples 1 to 5 and 9 with Comparative Example 2 in ΔVL confirms the effect of retarding the optical fatigue in the case where the content of the substance having the smallest content of the four types of the compounds falls within a range of from 0.01 parts to 20 parts. Comparing Example 1 with Comparative Example 9 and comparing Example 9 with Comparative Example 7 confirms that the case containing four types of compounds exhibits remarkable lightfastness as compared with the case containing three types of compounds. From the results of examples 1, 6, 8 and 9 and Comparative Examples 4 and 5, it is known that the case where the maximum absorption wavelengths of the substances are separated from each other by 10 nm or more exhibits good lightfastness. This may be considered because the case where the many substances each having a maximum absorption wavelength that falls in a wavelength range and is separated from that of the other substances by a predetermined distance or more can be shielded from external light falling within a broader wavelength range, and therefore of the case, the optical fatigue of the photoreceptor can be well retarded.

While the present invention has been described in detail and with reference to specific embodiments thereof, it will be apparent to one skilled in the art that various changes and modifications can be made therein without departing from the spirit and scope thereof. The present application is based on a Japanese patent application (Patent Application 2013-060368) filed Mar. 22, 2013, and the contents thereof are incorporated herein by reference.

REFERENCE SIGNS LIST

1 Photoreceptor (electrophotographic photoreceptor)
2 Charging Device (charging roller; charging part)
3 Exposure Device (exposure part)
4 Development Device (development part)
5 Transfer Device
6 Cleaning Device
7 Fixation Device
41 Development Tank
42 Agitator
43 Feed Roller
44 Development Roller
45 Control Member
71 Upper Fixation Member (fixation roller)
72 Lower Fixation Member (fixation roller)
73 Heating Device
T Toner
P Recording Paper (paper, medium)

The invention claimed is:

1. An electrophotographic photoreceptor comprising at least a photosensitive layer on a conductive substrate, wherein:

the photosensitive layer is a laminate having a charge transport layer and a charge generation layer, the charge transport layer contains four or more types of compounds each having a maximum absorption wavelength falling within a wavelength range of from 300 nm to 600 nm in a 0.001 mass % tetrahydrofuran solution at 25° C., and maximum absorption wavelengths falling within the wavelength range of at least four types of the compounds of said four or more types of the compounds are separated from each other by 10 nm or more, wherein at least one of the four or more types of compounds is selected from the group consisting of compounds represented by the following formulas (1), (2), (3), (5), (7), (8), and (9), and (11):

(1)

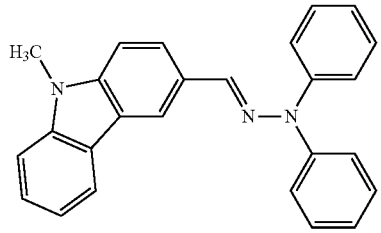

(2)

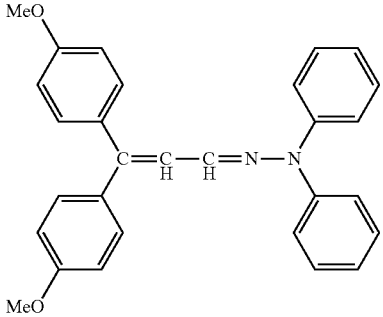

(3)

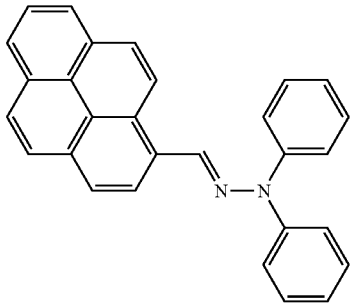

(5)

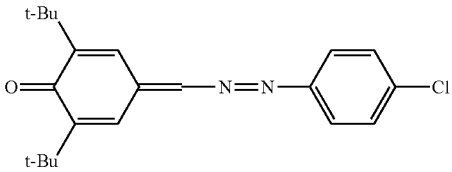

(7)

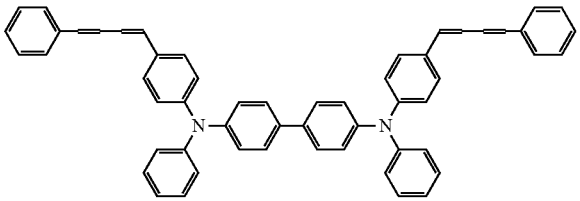

-continued (8)

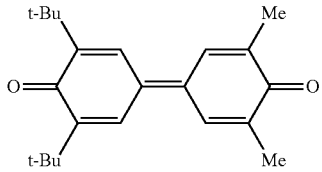

(9)

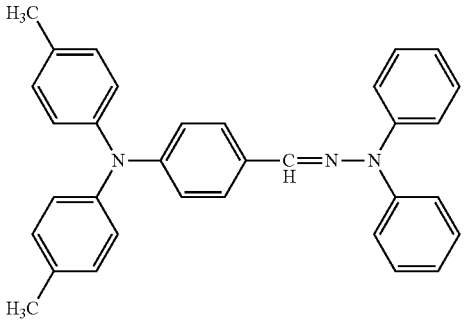

(11)

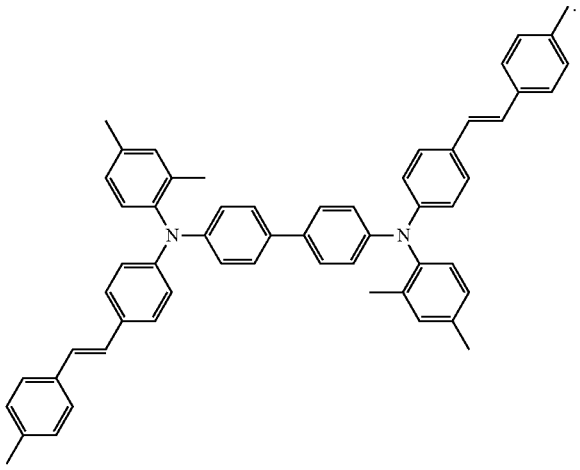

2. The electrophotographic photoreceptor according to claim 1, wherein the wavelength range is from 300 nm to 500 nm.

3. The electrophotographic photoreceptor according to claim 1, wherein the maximum absorption wavelengths falling within said wavelength range of at least four types of the compounds of said four or more types of the compounds are separated from each other by 20 nm or more.

4. The electrophotographic photoreceptor according to claim 1, wherein said four or more types of the compounds contain at least a compound of which the maximum absorption wavelength falls within a wavelength range of from 300 to 350 nm and a compound of which the maximum absorption wavelength falls within a wavelength range of from 450 to 500 nm.

5. The electrophotographic photoreceptor according to claim 1, wherein the charge transport layer contains a polyarylate resin or a polycarbonate resin.

6. The electrophotographic photoreceptor according to claim 1, wherein the charge generation layer contains a phthalocyanine.

7. The electrophotographic photoreceptor according to claim 1, wherein three or more types of said four or more types of the compounds are any three or more types of compounds represented by the following formula (I) to formula (VIII):

[Chem. 1]

(1)

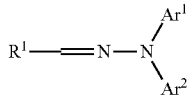

(In the formula (I), $Ar^1$ and $Ar^2$ each independently represent any of an aryl group, an alkoxy group or a hydrogen atom optionally having a substituent; and $R^1$ represents a substituent having from 12 to 30 carbon atoms)

[Chem. 2]

(II)

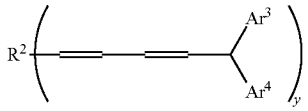

(In the formula (II), $Ar^3$ and $Ar^4$ each independently represent an aryl group, an alkoxy group or a hydrogen atom optionally having a substituent; $R^2$ represents a substituent having from 18 to 70 carbon atoms; and y indicates an integer of from 1 to 3)

[Chem. 3]

(III)

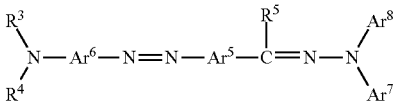

(In the formula (III), $Ar^5$ and $Ar^6$ each represent an arylene group; $Ar^7$ and $Ar^8$ each independently represent an aryl group or an alkoxy group optionally having a substituent; $R^3$ to $R^5$ each independently represent a hydrogen atom, an alkyl group, an alkoxy group, or an aryl group optionally having a substituent)

[Chem. 4]

(IV)

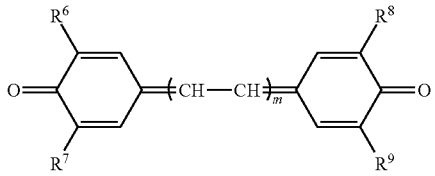

(In the formula (IV), $R^6$ to $R^9$ each independently represents an alkyl group having 6 or less carbon atoms; and m indicates 0 or 1)

[Chem. 5]

(V)

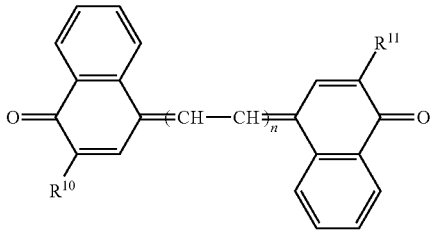

(In the formula (V), $R^{10}$and $R^{11}$ each independently represent an alkyl group having 6 or less carbon atoms; and n indicates 0 or 1)

[Chem. 6]

(VI)

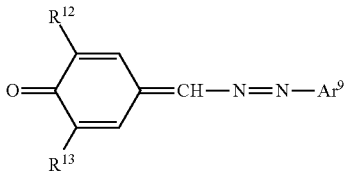

(In the formula (VI), $R^{12}$ and $R^{13}$ each independently represent an alkyl group having 6 or less carbon atoms; and $Ar^9$ represents an aryl group having 30 or less carbon atoms and optionally having a substituent)

[Chem. 7]

(VII)

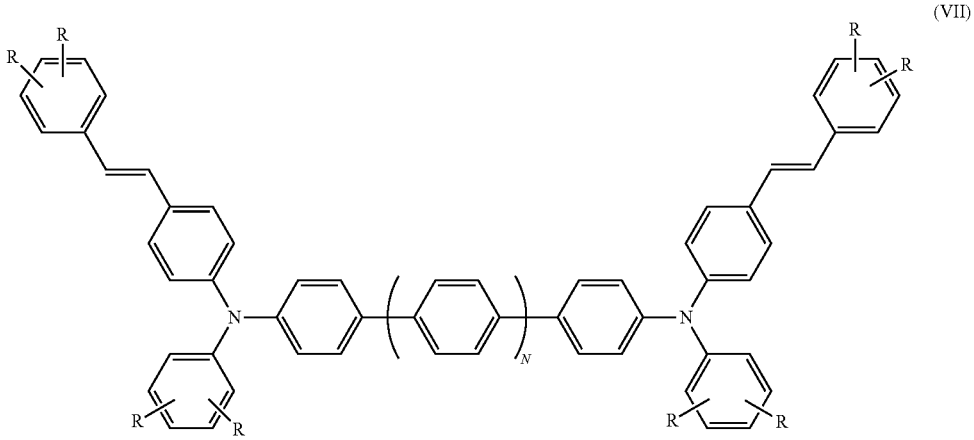

(In the formula (VII), R each independently represents a hydrogen atom, an alkyl group, an alkoxy group, or a phenyl group; and N indicates 0 or 1)

[Chem. 8]

(VIII)

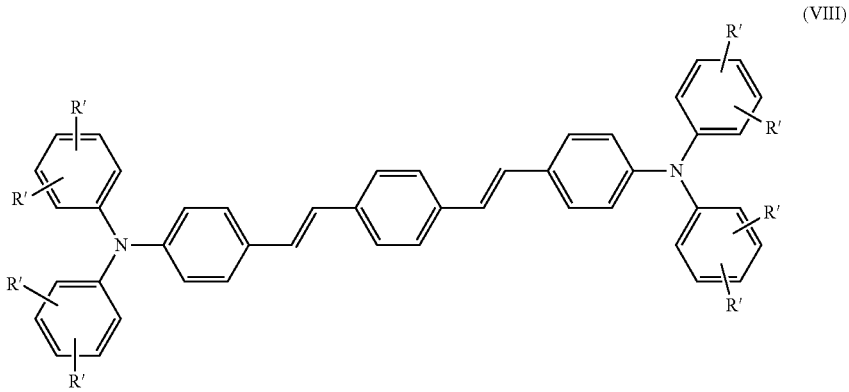

(In the formula (VIII), R' each independently represents a hydrogen atom, an alkyl group, an alkoxy group, or a phenyl group).

8. The electrophotographic photoreceptor according to claim 7, wherein the content in the charge transport layer of each of the other compounds than the compound having the largest content of said four or more types of the compounds is from 0.01 to 20 parts by mass relative to 100 parts by mass of the binder resin in the charge transport layer.

9. The electrophotographic photoreceptor according to claim 7, wherein the three or more types of said four or more types of the compounds are any three or more types of the compounds represented by the formula (IV), the formula (V) and the formula (VII).

10. The electrophotographic photoreceptor according to claim 1, wherein the content of the compound, of which the content is the smallest of said four or more types of the compounds, is from 0.01 to 20 parts by mass relative to 100 parts by mass of the binder resin in the charge transport layer.

11. An image formation device comprising the electrophotographic photoreceptor of claim 1, a charging means of charging the electrophotographic photoreceptor, an exposure means of exposing the charged electrophotographic photoreceptor to light to form an electrostatic latent image, a development means of developing the electrostatic latent image with a toner, a transfer means of transferring the toner to a transferred medium, and a fixation means of fixing the toner transferred to the transferred medium.

12. An image formation device comprising the electrophotographic photoreceptor of claim 1, a charging means of charging the electrophotographic photoreceptor, an exposure means of exposing the charged electrophotographic photoreceptor to light to form an electrostatic latent image, a development means of developing the electrostatic latent image with a toner, a transfer means of transferring the toner to a transferred medium, and a fixation means of fixing the toner transferred to the transferred medium, wherein a maximum exposure wavelength of the exposure light for use in the exposure means is from 650 nm to 900 nm.

13. The electrophotographic photoreceptor according to claim 1, wherein at least two of the four or more types of compounds are selected from the group consisting of compounds represented by the following formulas (1), (2), (3), (5), (7), (8), (9), and (11):

(1)
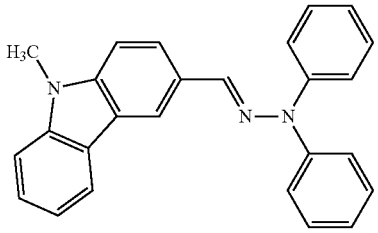
(2)
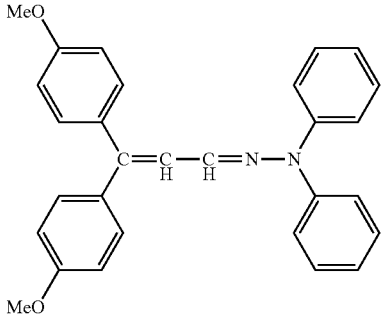
(3)
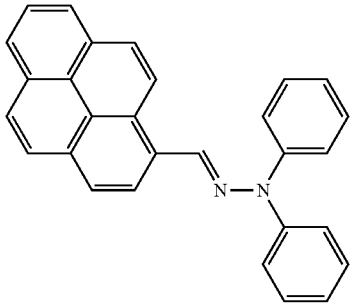
(5)
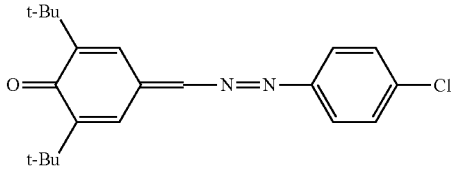
(7)
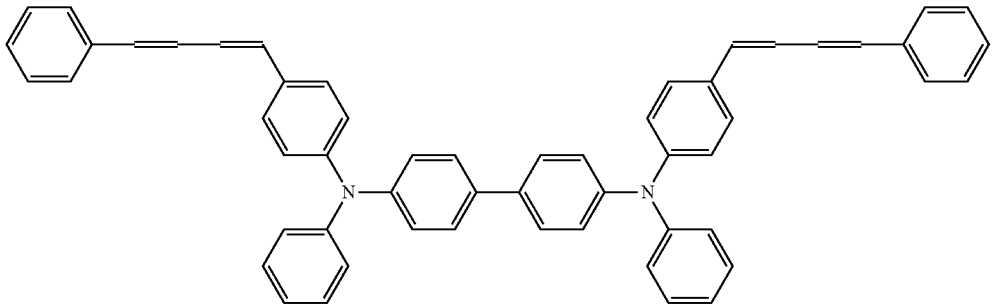
(8)
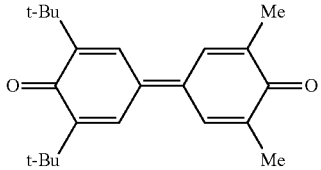
(9)
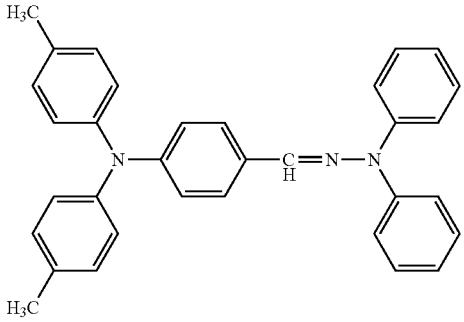

-continued
(11)
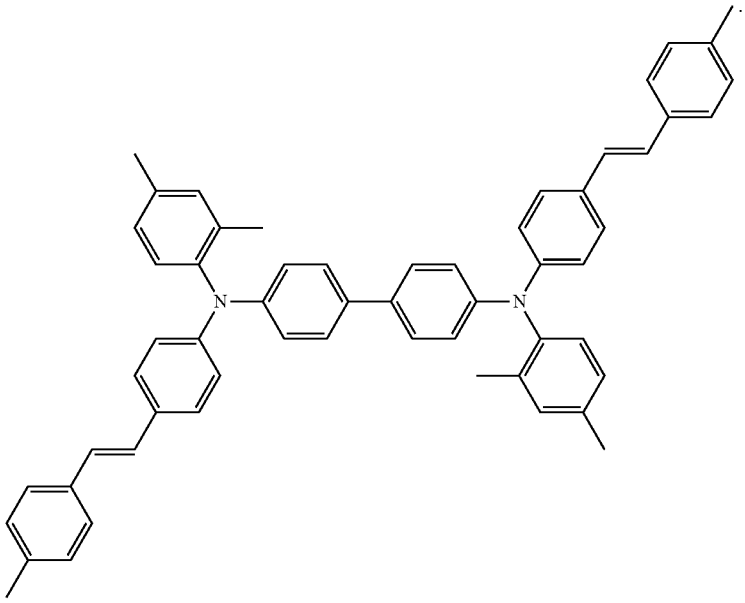
14. The electrophotographic photoreceptor according to claim 1, wherein at least three of the four or more types of compounds are selected from the group consisting of compounds represented by the following formulas (1), (2), (3), (5), (7), (8), (9), and (11):
(1)
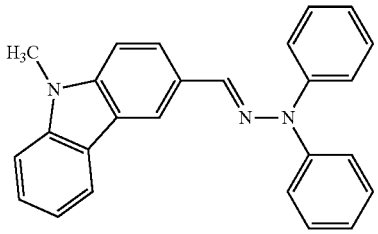
(2)
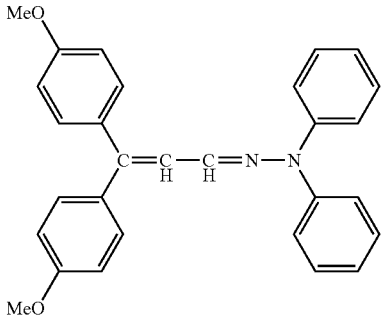
(3)
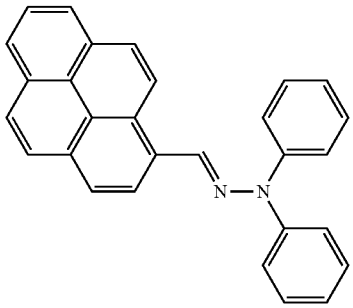
(5)
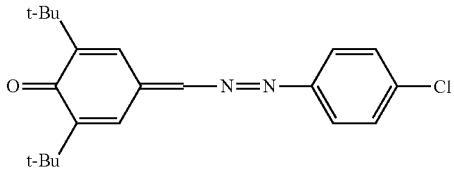

-continued
(7)
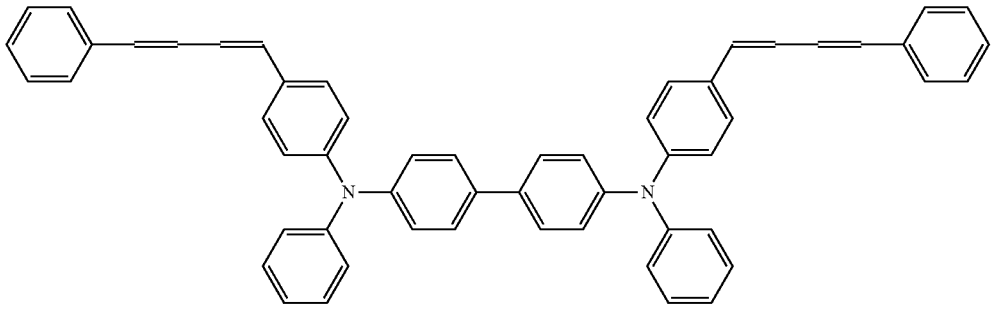
(8)
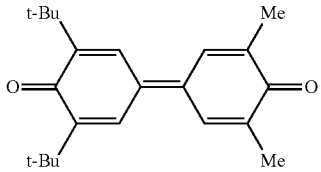
(9)
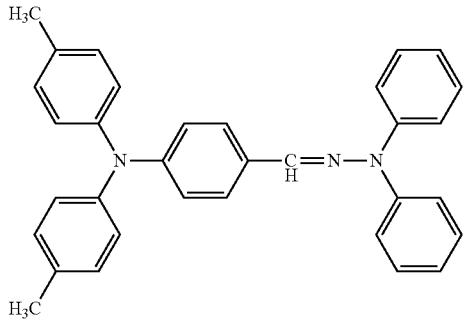
(11)
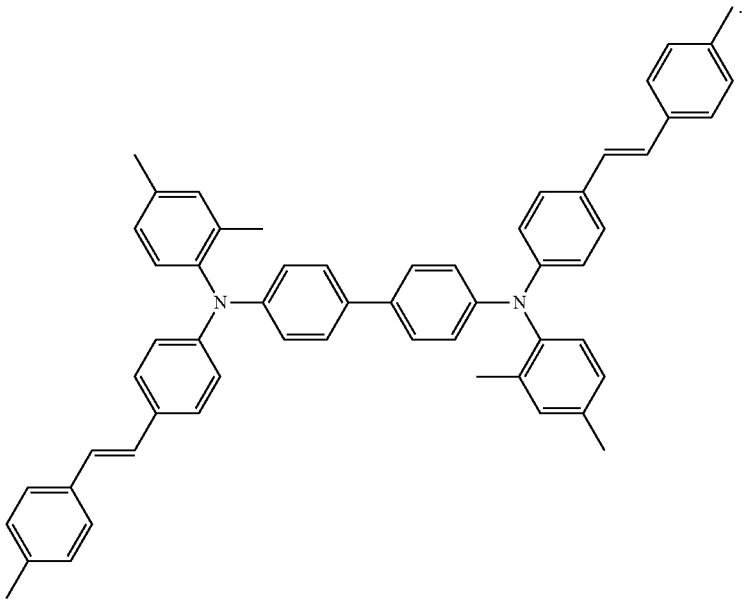
15. The electrophotographic photoreceptor according to claim 1, wherein at least four of the four or more types of compounds are selected from the group consisting of compounds represented by the following formulas (1), (2), (3), (5), (7), (8), (9), and (11):

(1)
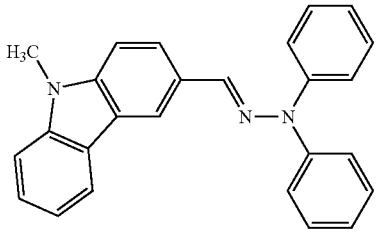
(2)
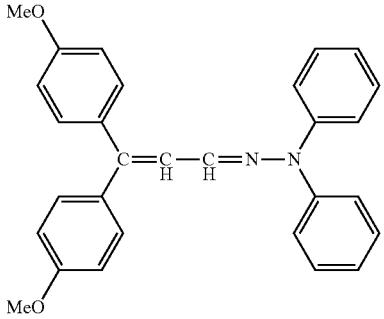
(3)
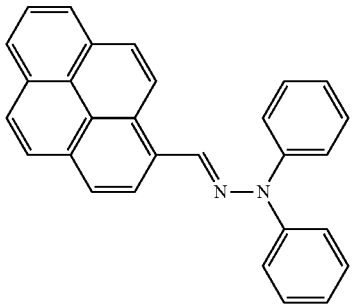
(5)
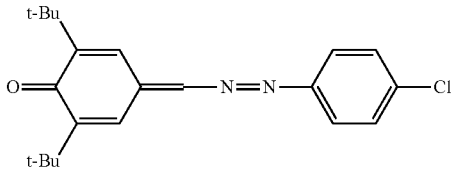
(7)
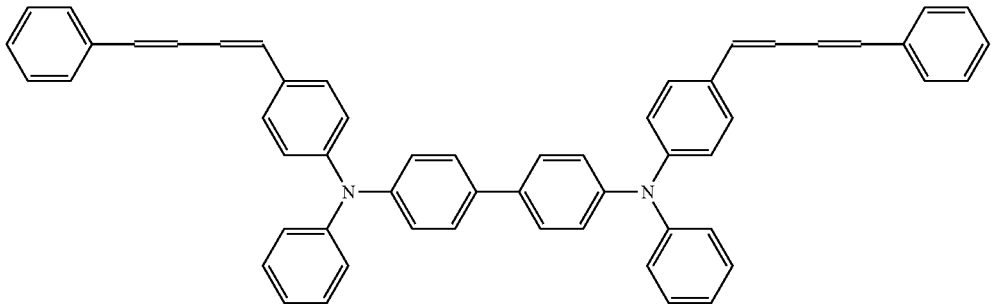
(8)
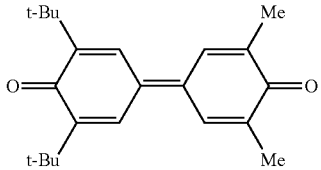
(9)
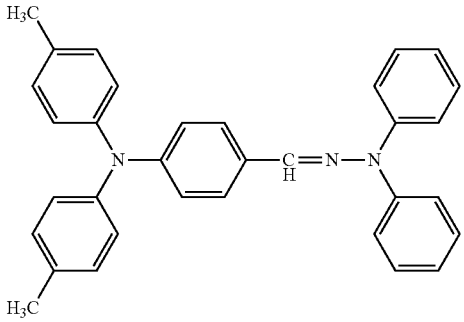

-continued
(11)
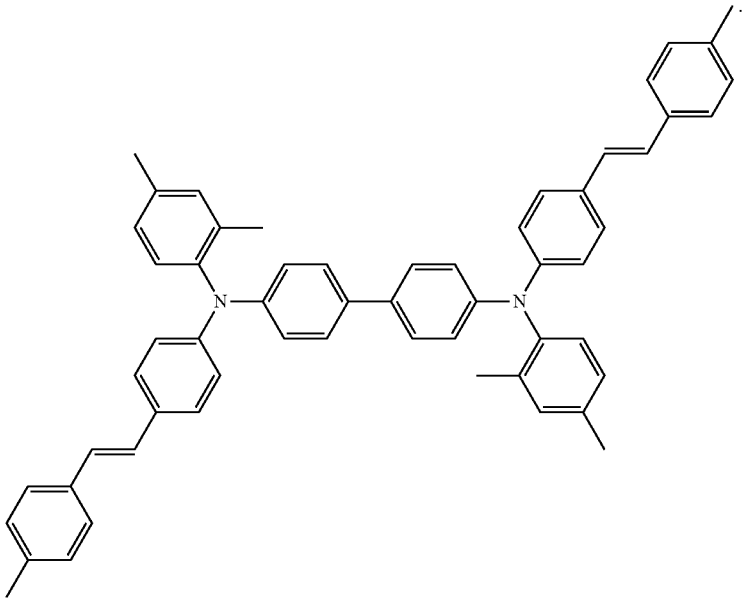
16. The electrophotographic photoreceptor according to claim 1, wherein at least four of the four or more types of compounds are represented by the following formulas (1), (3), (7), (9):
(1)
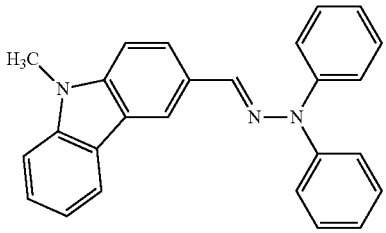
(3)
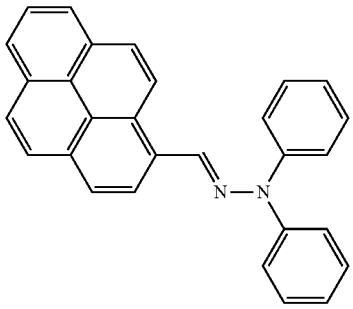

-continued
(7)
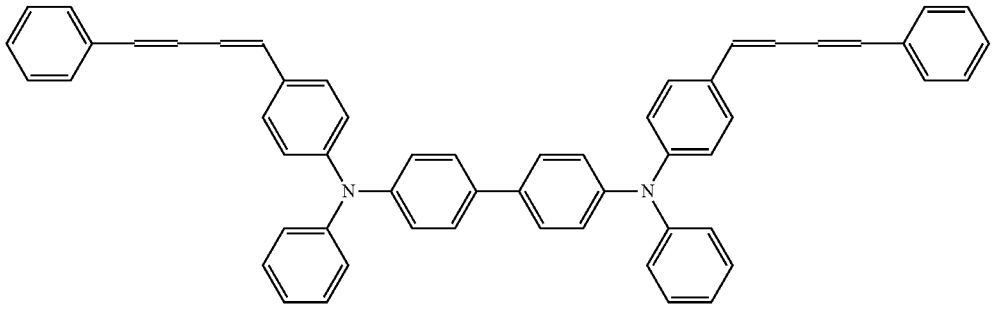
(9)
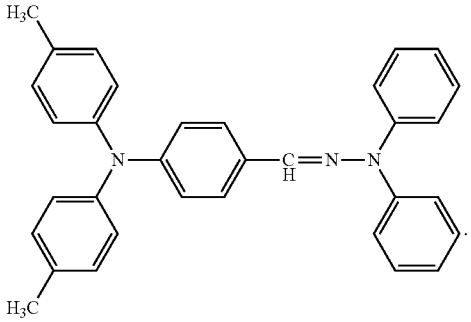
* * * * *